US009533850B2

(12) United States Patent
Yoshikawa et al.

(10) Patent No.: US 9,533,850 B2
(45) Date of Patent: Jan. 3, 2017

(54) IMAGE FORMING APPARATUS

(71) Applicant: Konica Minolta, Inc., Chiyoda-ku, Tokyo (JP)

(72) Inventors: Hiroyuki Yoshikawa, Toyohashi (JP); Yuta Tachibana, Toyokawa (JP); Takaki Kato, Toyokawa (JP); Daichi Suzuki, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/687,580

(22) Filed: Apr. 15, 2015

(65) Prior Publication Data

US 2015/0301491 A1 Oct. 22, 2015

(30) Foreign Application Priority Data

Apr. 17, 2014 (JP) ..... 2014-085845

(51) Int. Cl.
*B65H 7/20* (2006.01)
*B65H 5/06* (2006.01)
(Continued)

(52) U.S. Cl.
CPC ..... *B65H 7/20* (2013.01); *B65H 5/062* (2013.01); *B65H 5/068* (2013.01); *B65H 5/26* (2013.01); *B65H 7/06* (2013.01); *G03G 15/6564* (2013.01); *G03G 15/6529* (2013.01); *G03G 2215/00599* (2013.01); *G03G 2215/00603* (2013.01);
(Continued)

(58) Field of Classification Search
CPC ..... B65H 2513/10; B65H 2513/02; B65H 2513/04; B65H 2513/08; B65H 2513/20; B65H 2513/21; B65H 2513/22
See application file for complete search history.

(56) References Cited

U.S. PATENT DOCUMENTS 5,678,127 A 10/1997 Suga
6,826,384 B2 * 11/2004 Dobbertin ..... B65H 5/34 399/394
(Continued)

FOREIGN PATENT DOCUMENTS

JP H01-145944 A 6/1989
JP H06-16262 A 1/1994
(Continued)

OTHER PUBLICATIONS

Notice of Reasons for Rejection dated May 11, 2016 issued in the corresponding Japanese Patent Application No. 2014-085845 and English language translation (14 pages).

*Primary Examiner* — Jeremy R Severson
(74) *Attorney, Agent, or Firm* — Buchanan Ingersoll & Rooney PC

(57) ABSTRACT

An image forming apparatus includes a conveyance sensor disposed near a pair of conveyance rollers so as to accurately detect an amount of movement of the recording paper, a conveyance delay determination unit to determine a conveyance delay of the recording paper, and a conveyance control unit to control drive for rollers. The conveyance delay determination unit obtains conveyance delay information from among information detected with the conveyance sensor, or the like, and accelerates a rotational velocity of the pair of paper feed rollers when the conveyance delay quantity exceeds a threshold.

21 Claims, 24 Drawing Sheets

(51) Int. Cl.
*B65H 5/26* (2006.01)
*B65H 7/06* (2006.01)
*G03G 15/00* (2006.01)

(52) U.S. Cl.
CPC ..... *G03G 2215/00945* (2013.01); *G03G 2215/0132* (2013.01); *G03G 2215/0196* (2013.01)

(56) References Cited

U.S. PATENT DOCUMENTS 7,798,490 B2 * 9/2010 Tamura ..... B65H 9/002 271/227
8,070,250 B2 * 12/2011 Dohki ..... B41J 11/007 271/258.01
2004/0062582 A1 * 4/2004 Dobbertin ..... B65H 5/34 399/394
2009/0206540 A1 * 8/2009 Adachi ..... B65H 33/04 271/9.13
2009/0219553 A1 * 9/2009 Sutoh ..... B41J 11/425 358/1.9
2012/0256365 A1 * 10/2012 Yamagata ..... B65H 9/006 271/10.11
2013/0134645 A1 * 5/2013 Kato ..... B65H 31/00 270/58.07
2013/0134661 A1 * 5/2013 Yoshinaga ..... B65H 85/00 271/225
2013/0256985 A1 * 10/2013 Samoto ..... B65H 5/062 271/225
2014/0232055 A1 * 8/2014 Yamagata ..... B65H 7/02 271/3.18
2016/0152425 A1 * 6/2016 Inoue ..... B65H 3/06 271/10.03

FOREIGN PATENT DOCUMENTS

JP 07-319241 A 12/1995
JP H11-249525 A 9/1999
JP 2002-145467 A 5/2002
JP 2009-249093 A 10/2009

* cited by examiner

IMAGE FORMING APPARATUS

CROSS-REFERENCE TO RELATED APPLICATIONS

The present application claims priority under 35 U.S.C. §119 to Japanese Patent Application No. 2014-085845, filed Apr. 17, 2014. The contents of this application are incorporated herein by reference in their entirety.

BACKGROUND OF THE INVENTION

Field of the Invention

The present invention relates to an image forming apparatus.

Discussion of the Background

An image forming apparatus operates to cause a paper feed unit to deliver stored recording papers one by one to a conveyance path by paper feed rollers, and then cause conveyance rollers to conveyance the recording paper to an image forming unit so as to form an image on the recording paper. The image forming apparatus has timing rollers disposed at a position in front of the imaging forming unit on the conveyance path, and the timing rollers are to be driven to ensure that the recording paper is conveyed to the image forming unit in synchronization with image formation timing in the image forming unit. Conventionally, the image forming apparatus includes several sensors to detect the state of the recording paper on the conveyance path in order to ensure stable execution of the conveyance of the recording papers on the conveyance path (see Japanese Unexamined Patent Application Publication No. 07-319241).

Japanese Unexamined Patent Application Publication No. 07-319241 has proposed an image forming apparatus including a recording paper presence/absence sensor to detect the presence or absence of the recording paper in the paper feed unit, and a recording paper length detection sensor to detect the length of the recording paper which is disposed on the downstream side of the recording paper presence/absence sensor. The image forming apparatus according to Japanese Unexamined Patent Application Publication No. 07-319241 allows the paper feed rollers to keep rotating based on recording paper length information during the time that the recording paper presence/absence sensor detects the presence of the recording paper. On that occasion, the paper feed roller on the upstream side is allowed to keep rotating so as to assist the conveyance of the recording paper even in the state in which the fed recording paper reaches the conveyance rollers located on the downstream of the paper feed rollers.

In the conventional image forming apparatus, the rotational velocity of the paper feed rollers is set higher than the conveyance rollers so as to feed the recording papers of different types and thicknesses, thereby configuring so that the fed recording paper surely reaches a conveyance sensor close to the conveyance rollers within a predetermined period of time. With the image forming apparatus, when the conveyance sensor detects the front end of the fed recording paper, the rotational operation of the paper feed rollers on the downstream side is suspended to inhibit excessive conveyance of the recording paper by the continuous rotation of the paper feed rollers, thereby preventing the occurrence of damage, such as paper folding.

When the rotation of the paper feed rollers is suspended at the timing at which the conveyance sensor detects the front end of the recording paper in the conventional image forming apparatus, the paper feed rollers are to be suspended in the state in which the recording paper being conveyed by the conveyance rollers is caught in the paper feed rollers. Therefore, the load exerted on the conveyance rollers is increased by the amount of frictional resistance of the recording paper caught in the paper feed rollers, and a slip may occur between the conveyance rollers and the recording paper. The occurrence of the slip may cause a delay in the conveyance velocity of the recording paper, thus leading to the occurrence of a timer jam (virtual paper jam due to the passage of time) or deterioration of productivity in the recording paper conveyance. With this image forming apparatus, a recording paper detection sensor disposed on the conveyance path is to measure passage time of the recording paper. When the passage time is longer than a predetermined period of time, a determination is made that the timer jam has occurred.

With the configuration of Japanese Unexamined Patent Application Publication No. 07-319241, the amount of feed of the recording paper by the conveyance rollers on the downstream side is decreased when the slip of the recording paper occurs on the conveyance rollers on the downstream side. On that occasion, the paper feed rollers on the upstream side perform the rotational operation only a predetermined period of time determined with the recording paper length information, so that the rotational operation of the paper feed rollers may be suspended during the conveyance of the recording paper by the paper feed rollers. Consequently, the amount of slip on the conveyance rollers is increased, and the amount of movement (velocity) of the recording paper is further reduced (decelerated). Hence, even with the configuration of Japanese Unexamined Patent Application Publication No. 07-319241, the occurrence of the slip contributes to the occurrence of the timer jam or the deterioration of the productivity in the recording paper conveyance.

In view of the foregoing problems, the present invention has an object to provide an image forming apparatus capable of stably conveying the recording papers regardless of the presence or absence of the occurrence of a slip during the recording paper conveyance.

SUMMARY OF THE INVENTION

According to one aspect of the present invention, an image forming apparatus includes paper feed rollers and conveyance rollers disposed sequentially from an upstream side along a conveyance path for a recording paper, a driving source to transmit a rotational power to the paper feed rollers and the conveyance rollers, and a conveyance sensor disposed near the conveyance rollers so as to measure a conveyance velocity of the recording paper to be conveyed along the conveyance path. The image forming apparatus includes a conveyance delay determination unit to calculate a conveyance delay quantity of the recording paper on the conveyance path and compare the conveyance delay quantity and a predetermined threshold. When the conveyance delay determination unit indicates that the conveyance delay quantity exceeds the threshold, the driving source is to accelerate a rotational velocity of the paper feed rollers.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 2:
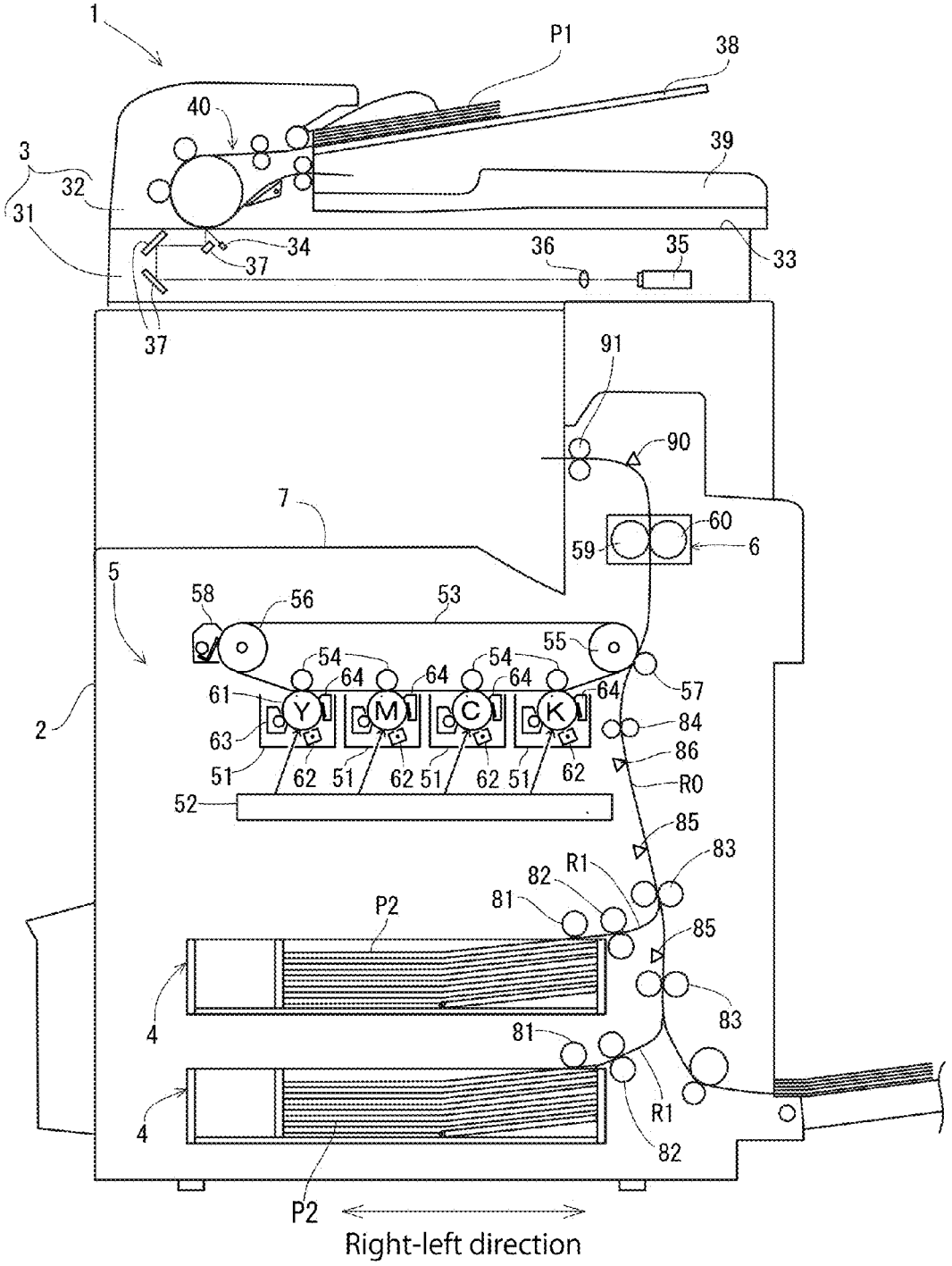
FIG. 2 is a schematic block diagram showing an internal structure of the image forming apparatus shown in FIG. 1.

Embodiments of the present invention are described below with reference to the drawings. When terms indicating specific directions and positions (for example, "left and right" and "up and down") are used in the following description as necessary, a direction orthogonal to the paper surface in FIG. 2 is taken as a front view, and this direction is used as reference. These terms are used for purposes of convenience of description and are not intended to limit the technical scope according to the embodiment of the present invention.

<Structure of Image Forming Apparatus>

Figure 1:
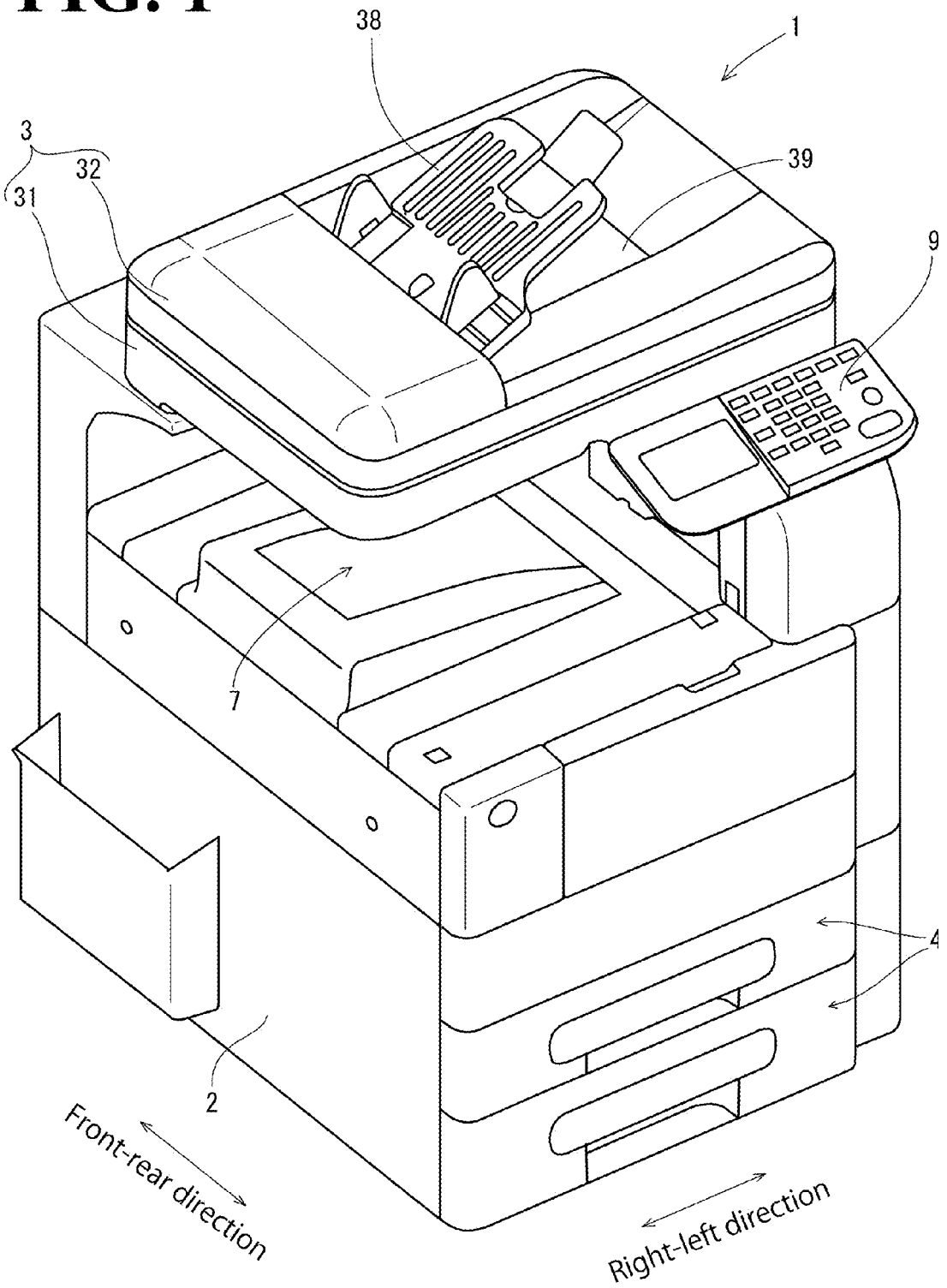
FIG. 1 is an external perspective view of an image forming apparatus according to an embodiment of the present invention.

An overall structure of the image forming apparatus that is common to the following embodiments according to the embodiment of the present invention will be described with reference to the drawings. FIG. 1 is an external perspective view of the image forming apparatus according to the embodiment of the present invention. FIG. 2 is a schematic diagram showing an internal structure of the image forming apparatus.

As shown in FIGS. 1 and 2, the image forming apparatus 1 includes an image reading unit 3 to read an image from an original P1, a paper feed tray 4 to store therein a recording paper P2 on which the image is to be formed, a transfer unit 5 to transfer a toner image to the recording paper P2 fed from the paper feed tray 4, a fixing unit 6 to fix the toner image transferred by the transfer unit 5 to the recording paper P2, a paper discharge tray 7 to which the recording paper P2 having thereon the image fixed and formed by the fixing unit 6 is discharged, and an operation panel 9 to accept an operation to the image forming apparatus 1. The image reading unit 3 is disposed on an upper side of an apparatus main body 2 of the image forming apparatus 1, and the transfer unit 5 is disposed below the image reading unit 3.

The paper feed tray 7 is disposed above the transfer unit 5 in the apparatus main body 2 so as to receive the recording paper P2 discharged after being subjected to image recording in the transfer unit 5 and the fixing unit 6, and the paper feed tray 4 is insertable and drawable below the transfer unit 5 in the apparatus main body 2. With this configuration, the recording paper P2 stored in the paper feed tray 4 is fed into the apparatus main body 2 and is then conveyed upward as described later. Accordingly, after the image is transferred to the recording paper P2 by the transfer unit 5 disposed above the paper feed tray 4 and is fixed by the fixing unit 6, the recording paper P2 is discharged to the paper discharge tray 7 disposed in space (recessed space) between the image reading unit 3 and the transfer unit 5.

The image reading unit 3 disposed on an upper side of the apparatus main body 2 includes a scanner unit 31 to read the image from the originals P1, and an automatic original conveyance unit (ADF: auto document feeder) 32 that is disposed on an upper side of the scanner unit 31 and is to conveyance the originals P1 one by one to the scanner unit 31. The operation panel 9 is disposed on a front side of the apparatus main body 2. A user is capable of performing a setting operation about a function selected from various kinds of functions of the image forming apparatus 1 and instructing the image forming apparatus 1 to execute an operation by performing a key operation while watching a display screen or the like of the operation panel 9.

An internal structure of the apparatus main body 2 will be described below with reference to FIG. 2. The scanner unit 31 of the image reading unit 3 disposed on the upper side of the apparatus main body 2 includes an original table 33 having a platen glass (not shown) on the upper surface thereof, a light source unit 34 to irradiate light to the original P1, an image sensor 35 to photoelectrically convert reflected light from the original P1 into image data, an imaging lens 36 to focus the reflected light onto the image sensor 35, and a mirror group 37 to sequentially reflect the reflected light from the original P1 so as to enter the imaging lens 36. The light source unit 34, the image sensor 35, the imaging lens 36, and the mirror group 37 are disposed inside the original table 33. The light source unit 34 and the mirror group 37 are movable leftward and rightward with respect to the original table 33.

The ADF 32 is disposed on the upper surface of the scanner unit 31 so as to be openable and closable with respect to the original table 33. The ADF 32 also has a role in bringing the original P1 into close contact with the platen glass (not shown) by being laid over the original P1 on the platen glass (not shown) of the original table 33. The ADF 32 includes an original mounting tray 38 and an original discharge tray 39.

When the original P1 on the platen glass (not shown) of the original table 33 is read in the image reading unit 3 thus configured, light is irradiated from the light source unit 34 to be moved rightward (in a sub scanning direction) to the original P1. The reflected light that is reflected from the original P1 is sequentially reflected by the mirror group 37, which is to be moved rightward similarly to the light source unit 34, so as to enter the imaging lens 36 and to be focused on the image sensor 35. The image sensor 35 performs photoelectric conversion of incident light on a pixel basis depending on the intensity of the incident light, thereby generating image signals (RGB signals) corresponding to the image of the original P1.

When reading an original P1 mounted on the original mounting tray 38, the original P1 is conveyed to a reading position by an original conveyance mechanism 40 made up of a plurality of rollers and the like. On that occasion, the light source unit 34 and the mirror group 37 of the scanner unit 31 are respectively secured to predetermined positions inside the original table 33. Accordingly, light is irradiated to a reading position area of the original P1 by the light source unit 34, and the reflected light thereof is focused on the image sensor 35 through the mirror group 37 and the imaging lens 36 of the scanner unit 31. Then, the image sensor 35 converts it into the image signals (RGB signals) corresponding to the image of the original P1. Thereafter, the original P1 is discharged to the original discharge tray 39.

The transfer unit 5 to transfer a toner image onto the recording paper P2 includes imaging units 51, exposure units 52, an intermediate transfer belt 53, primary transfer rollers 54, a drive roller 55, a driven roller 56, a secondary transfer roller 57, and a cleaner unit 58. The imaging units 51 are to generate toner images respectively having colors of Y (yellow), M (magenta), C (cyan), and K (key tone). The exposure units 52 are respectively disposed below the imaging units 51. The intermediate transfer belt 53 is to be brought into contact with the imaging units 51 for their respective colors disposed in a horizontal direction, so that the toner images of their respective colors are transferred from the imaging units 51 to the intermediate transfer belt 53. The primary transfer rollers 54 are respectively disposed at positions located above and opposed to the imaging units 51 for their respective colors so as to hold therebetween the imaging units 51 and the intermediate transfer belt 53. The drive roller 55 is to rotate the intermediate transfer belt 53. The driven roller 56 is to be rotated according to the rotation of the drive roller 55 which is transmitted thereto via the intermediate transfer belt 53. The secondary transfer roller 57 is disposed at a position opposed to the drive roller 55 so as to interpose the intermediate transfer belt 53 therebetween. The cleaner unit 58 is disposed at a position opposed to the driven roller 56 so as to interpose the intermediate transfer belt 53 therebetween.

Each of the imaging units 51 includes a photoconductor drum 61 to be brought into contact with an outer peripheral surface of the intermediate transfer belt 53, a charger 62 to charge the outer peripheral surface of the photoconductor drum 61 by corona discharge, a developer 63 to allow a toner that is charged by being stirred to be attached to the outer peripheral surface of the photoconductor drum 61, and a cleaner unit 64 to remove the toner remaining on the outer peripheral surface of the photoconductor drum 61 after the toner image is transferred to the intermediate transfer belt 53. Here, the photoconductor drum 61 is located at a position opposed to the primary transfer roller 54 so as to interpose the intermediate transfer belt 53 therebetween, and is also rotated clockwise in FIG. 2. The primary transfer roller 54, the cleaner unit 64, the charger 62, and the developer 63 are sequentially disposed around the photoconductor drum 61 and along the rotational direction of the photoconductor drum 61.

The intermediate transfer belt 53 is made of, for example, an endless belt member having conductivity, and is entrained with no slack around the drive roller 55 and the driven roller 56, thereby ensuring that the intermediate transfer belt 53 is rotated counterclockwise in FIG. 2 according to the rotation of the drive roller 55. The secondary transfer roller 57, the cleaner unit 58, and the imaging units 51 respectively for the colors of YMCK are sequentially disposed around the intermediate transfer belt 53 and along the rotational direction of the intermediate transfer belt 53.

The fixing unit 6 to fix the toner image transferred to the recording paper P2 includes a heating roller 59 including, for example, a halogen lamp that applies heat to the toner image on the recording paper P2 so as to fix the toner image, and a pressure roller 60 that holds the recording paper P2 together with the heating roller 59 so as to apply pressure to the recording paper P2. The heating roller 59 may be configured so that eddy currents are generated on the surface thereof by electromagnetic induction so as to heat the surface of the heating roller 59.

The conveyance device to conveyance the recording paper P2 includes a delivery roller 81, a pair of paper feed rollers 82, a pair of conveyance rollers 83, and a pair of timing rollers 84. The delivery roller 81 delivers the recording paper P2 stored in the paper feed tray 4 from the uppermost layer of the recording papers P2 to a paper feed path R1. The pair of paper feed rollers 82 further deliver the delivered recording paper P2 to the paper feed path R1. The pair of conveyance rollers 83 vertically conveys, along a main conveyance path R0, the recording paper P2 fed by the pair of paper feed rollers 82. The pair of timing rollers 84 are disposed on the downstream side of the pair of conveyance rollers 83 on the main conveyance path R0, and are to conveyance the recording paper P2 toward the transfer unit 5. The main conveyance path R0 is the main path of the recording papers P2 to be subjected to the process of image formation (printing). The paper feed path R1 is disposed for each of the paper feed trays 4, and the paper feed paths R1 join the main conveyance path R0.

The recording papers P2 in each of the paper feed trays 4 are delivered one by one from those in the uppermost layer by the rotational driving of the corresponding delivery roller 81, and are then delivered toward the main conveyance path R0 by the pair of paper feed rollers 82. On the main conveyance path R0, the recording paper P2 delivered from the pair of paper feed rollers 82 is conveyed toward the pair of timing rollers 84 disposed in front of the transfer unit 5 by the rotational driving of the pair of conveyance rollers 83. The pair of timing rollers 84 are to conveyance the recording paper P2 to the transfer unit 5 in synchronization with timing of a toner image formation in the transfer unit 5 in order to allow the toner image to be normally transferred to the recording paper P2. That is, at the moment that the recording paper P2 is conveyed to the pair of timing rollers 84 by the pair of conveyance rollers 83, the pair of timing rollers 84 are brought into their suspension state, so that the recording paper P2 slackens to form a loop. The loop is used to correct a skew of the recording paper P2, and the recording paper P2 is then conveyed to the secondary transfer roller 57.

A conveyance sensor (recording paper detection unit) 85 to detect the recording paper P2 vertically conveyed by the pair of conveyance rollers 83 is disposed above the pair of conveyance rollers 83 (on the downstream side in a conveyance direction) on the main conveyance path R0. A pre-timing sensor (recording paper detection unit) 86 to detect the front end of the recording paper P2 that has reached the front of the pair of timing rollers 84 is disposed below the pair of timing rollers 84 (on the upstream side in the conveyance direction). A paper conveyance and a loop control on the main conveyance path R0 are to be executed based on detection signals respectively issued from the conveyance sensor 85 and the pre-timing sensor 86.

A pair of paper discharge rollers 91 to discharge the recording paper P2 having print thereon is disposed at a terminal portion corresponding to the most downstream side of the main conveyance path R0. The recording paper P2 having print thereon is to be discharged to the discharge tray 7 by rotational driving of the pair of paper discharge rollers 91. A paper discharge sensor (recording paper detection unit) 90 to detect the rear end of the recording paper P2 is disposed below the pair of paper discharge rollers 91 (on the upstream side in the conveyance direction). Therefore, the detection of the rear end of the recording paper P2 by the paper discharge sensor 90 makes it possible to indicate that the recording paper P2 has been normally discharged from the pair of paper discharge rollers 91 to the paper discharge tray 7.

Figure 3:
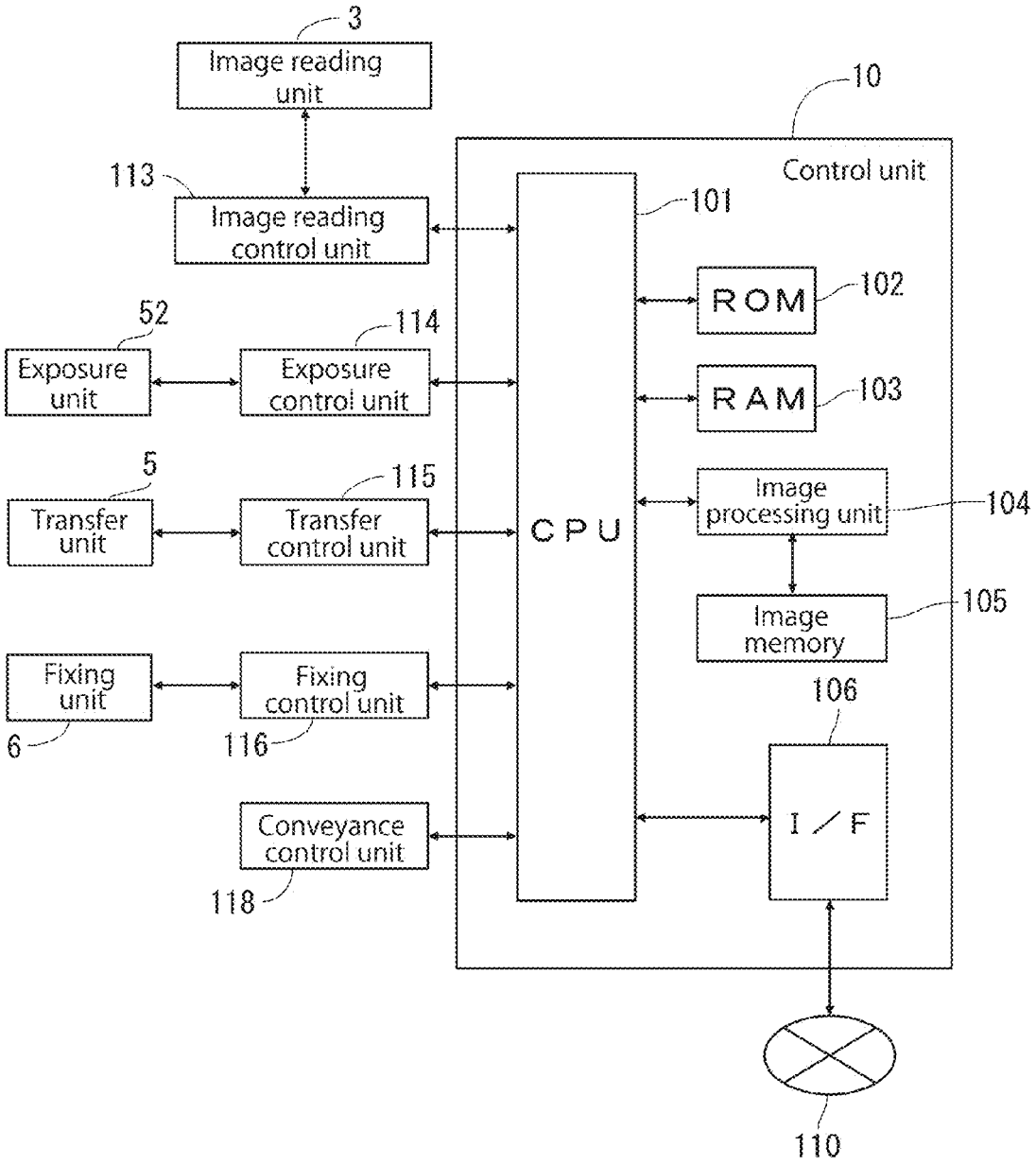
FIG. 3 is a block diagram showing a configuration of a control unit of the image forming apparatus shown in FIG. 1.

The image forming apparatus 1 includes the control unit 10 having the configuration shown in FIG. 3. The control unit 10 is to control individual units constituting the image forming apparatus 1 so as to execute various kinds of operations, such as a printing operation to the recording paper P2 and an image reading operation with respect to the original P1. The control unit 10 includes a CPU (central processing unit) 101 to execute various kinds of arithmetic processing and controls, a ROM (read only memory) 102 to store a control program and the like, a RAM (random access memory) 103 to temporarily store operation data, an image processing unit 104 to generate image data that become the basis of a toner image to be formed by the transfer unit 5, an image memory 105 to temporarily store the image data obtained with the image processing unit 104, and an input-output interface 106 to send and receive a signal to and from the units constituting the image forming apparatus 1.

When the control unit 10 thus configured receives a signal corresponding to an operation accepted through the operation panel 9, the CPU 101 recognizes an operation based on the operation accepted through the operation panel 9. Similarly, when the input-output interface 106 receives a signal to be sent from an external terminal or the like via a communication network 110, such as LAN (local area network), the control unit 10 recognizes an operation designated by the external terminal. Accordingly, the CPU 101 reads from the ROM 102 a control program based on the operation designated through the operation panel 9 or the external terminal, and the CPU 101 operates based on the control program.

At this time, the CPU 101 outputs signals respectively to an image reading control unit 113, an exposure control unit 14, a transfer control unit 115, a fixing control unit 116, and a conveyance control unit 118, which respectively control the image reading unit 3, the exposure unit 52, the transfer unit 5, the fixing unit 6, and a paper feed device 8, based on the control program read from the ROM 102. Upon application of the signals from the control unit 10 respectively to the image reading control unit 113, the transfer control unit 115, and the fixing control unit 116, the image forming apparatus 1 causes the image reading unit 3, the exposure unit 52, the transfer unit 5, and the fixing unit 6 to be driven according to the designated operation. Upon application of the signals from the control unit 10 to the conveyance control unit 118, the image forming apparatus 1 causes the feed roller 81 in the conveyance device, and the pair of rollers 82 to 84, and 90 to be rotationally driven.

<Printing Operation of Image Forming Apparatus>

The printing operation of the image forming apparatus 1 will be described below. When the image forming apparatus 1 receives an instruction to perform the printing operation through the operation panel 9 or the external terminal, the CPU 101 in the control unit 10 reads the control program for the printing operation from the ROM 102 so as to initiate the control operation for the printing operation. Firstly, the CPU 101 causes the conveyance control unit 118 to perform drive control of the conveyance device so that the recording paper P2 is delivered from the uppermost layer in the paper feed tray 4 and is fed to the main conveyance path R0.

In order to transfer a toner image to the recording paper P2 fed to the main conveyance path R1, the CPU 101 applies a control signal to the exposure control unit 114 and the transfer control unit 115 so as to perform drive control of the exposure unit 52 and the transfer unit 5. At this time, the CPU 101 causes the image reading control unit 113 to apply to the image processing unit 103 an image signal read from the original P1 by the image reading unit 3, or an image received from the external terminal through the input-output interface 106.

Accordingly, the image processing unit 103 generates image data for forming toner images of their respective colors Y, M, C, and K based on the applied image signals, and causes the image memory 105 to store the image data. The image data of their respective colors Y, M, C, and K stored in the image memory 105 are to be read and applied to the exposure control unit 114 by the CPU 101. Based on the image data of the respective colors of Y, M, C, and K, the exposure control unit 114 causes light-emitting devices (not shown) in the exposure unit 52 to be driven to form electrostatic latent images respectively on the photoconductor drums 61 for the colors Y, M, C, and K. That is, the transfer control unit 115 causes the transfer unit 5 to be driven. Therefore, in the imaging units 51 for the colors of Y, M, C, and K, laser light is irradiated from the exposure unit 52 to the surfaces of the photoconductor drums 61 charged by the charger 62 so as to form the electrostatic latent images corresponding to the images of the colors of Y, M, C, and K.

The toner charged in the developer 63 is transferred to the surfaces of the photoconductor drums 61 having the electrostatic latent image formed thereon, thereby forming the toner image on the photoconductor drum 61 serving as a first image carrier. When the toner image carried on the surface of the photoconductor drum 61 is brought into contact with the intermediate transfer belt 53, the toner image is transferred to the intermediate transfer belt 53 by electrostatic force of the primary transfer roller 54. Therefore, the toner image having the colors of Y, M, C, and K overlapped one another is formed on the surface of the intermediate transfer belt 53 serving as a second image carrier. Untransferred toner remaining on the photoconductor drum 61 from which the toner image is already transferred to the intermediate transfer belt 53 is scraped off by the cleaner unit 64 and is removed from the surface of the photoconductor drum 61.

When the front end of the recording paper P2 conveyed to the main conveyance path R0 is detected by the pre-timing sensor 86, a detection result thereof is applied to the transfer control unit 115, and therefore the transfer control unit 115 recognizes that the recording paper P2 has reached the pair of timing rollers 84. The transfer control unit 115 causes the pair of timing rollers 84 to operate at such timing that the toner image is transferred to the intermediate transfer belt 53. At this time, the intermediate transfer belt 53 is rotated by the drive roller 55 and the driven roller 56. This ensures that the toner image transferred to the intermediate transfer belt 53 is moved to a transfer position to be contacted with the second transfer roller 57 so as to be transferred to the recording paper P2 that is to be conveyed to the transfer position on the main conveyance path R0. Untransferred toner remaining on the intermediate transfer belt 53, by which the toner image is transferred to the recording paper P2, is scraped off by the cleaner unit 58 and is removed from the surface of the intermediate transfer belt 53.

Subsequently, the recording paper P2 having the toner image transferred thereto at the contact position with the secondary transfer roller 57 is conveyed to the fixing unit 6 made up of the heating roller 59 and the pressure roller 60. At this time, in order to fix the toner image on the recording paper P2 to be conveyed to the fixing unit 6, the CPU 101 causes the fixing control unit 116 to perform drive control of the fixing unit 6 (STEP 123). That is the fixing control unit 116 controls rotating actions of the heating roller 59 and the pressure roller 60 and, at the same time, controls heating action of the heating roller 59.

This ensures that the recording paper P2 having an unfixed toner image thereon is heated by the heating roller 59 and is pressed by the pressure roller 60 when the recording paper P2 passes through a fixing nip portion of the fixing unit 6. Consequently, the unfixed toner image is fixed to the paper surface. The recording paper P2 after the toner image is fixed thereto (after one side printing) is conveyed to the pair of paper discharge rollers 91 and then discharged to the paper discharge tray 7 by the pair of paper discharge rollers 91. At this time, the paper discharge sensor 90 detects the rear end of the recording paper P2, and the detection result thereof is applied to the control unit 10. Upon this, the control unit 10 indicates that the recording paper P2 is already normally discharged to the paper feed tray 7.

<Structure of Recording Paper Detection Unit>

Figure 4:
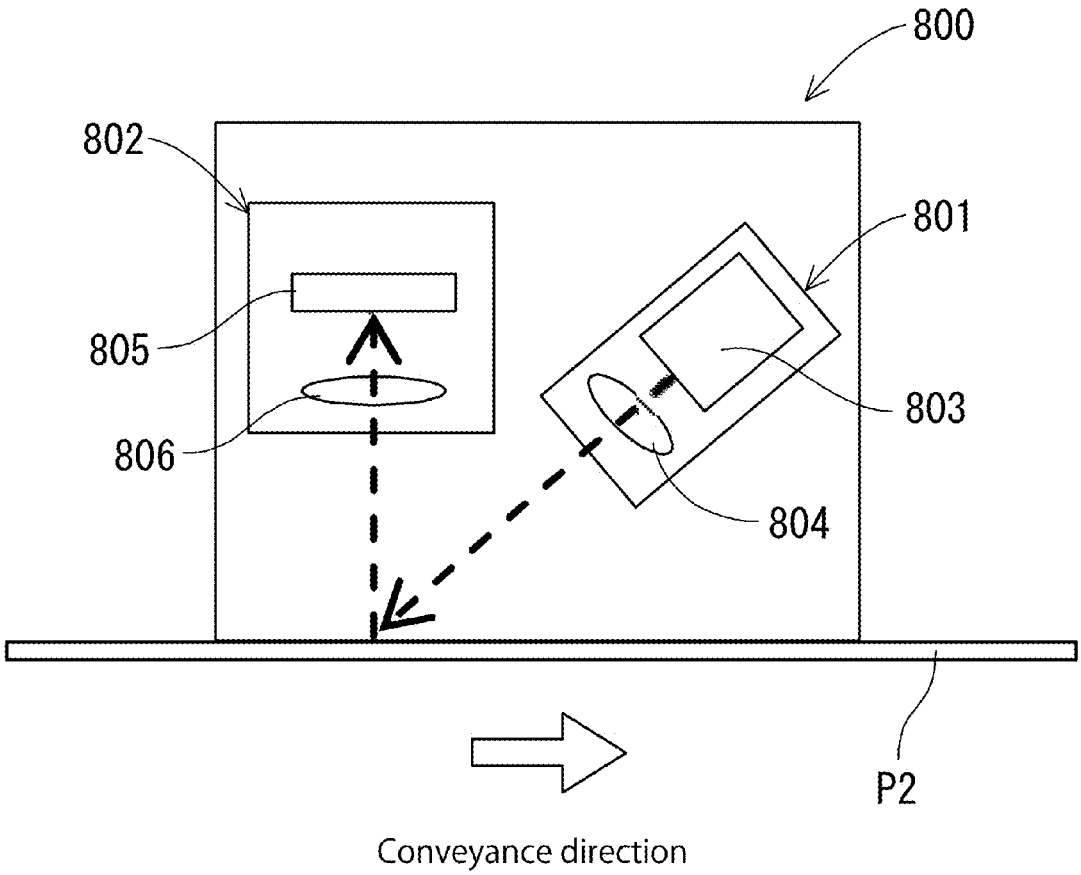
FIG. 4 is a schematic diagram showing a structure of a recording paper detection unit in the image forming apparatus according to the embodiment of the present invention.

The structure of a recording paper detection unit 800 of the conveyance sensor 85 or the like will be described briefly below with reference to the drawings. As shown in FIG. 4, the recording paper detection unit 800 includes a light emitting unit 801 to irradiate light to the recording paper P2, and a light receiving unit 802 to photoelectrically convert a reflected light from the recording paper P2 into an electrical signal. The recording paper detection unit 800 converts the electrical signal from the light receiving unit 802 into a detection signal and outputs the detection signal to the control unit 10 or the conveyance control unit 118.

Figure 5:
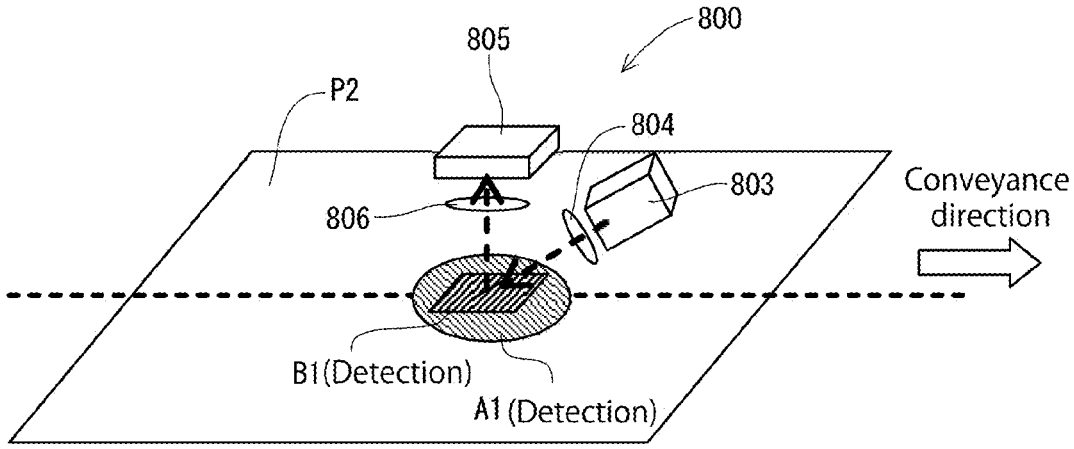
FIG. 5 is a diagram showing a relationship between an irradiation region and a detection region by the recording paper detection unit in FIG. 4.

The light emitting unit 801 is a predetermined distance (for example, 5 to 10 mm) away from the recording paper P2 in the conveyance path and at a predetermined angle, and the light emitting unit 801 irradiate light from a light source 803 housed therein onto the recording paper P2 via an optical system 804. The light receiving unit 802 is disposed a predetermined distance (for example, 7 to 12 mm) from the recording paper P2 in the conveyance path, and an image sensor 805 housed in the light receiving unit 802 is disposed approximately parallel to the recording paper P2. The reflected light from the surface of the recording paper P2 is to be received by an image sensor 805 through the optical system 806. That is, as shown in FIG. 5 on the surface of the recording paper P2, a detection region B1 to be focused onto the image sensor 805 of the light receiving unit 802 is to be formed inside an irradiation region A1 to which the light from the light emitting unit 801 is irradiated.

When the recording paper detection unit 800 having the above configuration is an LED type sensor, the light emitting unit 801 houses therein a light emitting diode (LED) as the light source 803, and the light receiving unit 802 is to receive a brightness pattern of light due to irregularities of the surface of the recording paper P2, and the like. In the light receiving unit 802, the brightness pattern is to be formed on the surface of the image sensor 805 through the optical system 806. Then, the image sensor 805 outputs, as a detection signal, an electrical signal (image signal) based on the formed brightness pattern. The brightness pattern is to formed not only by a character or pattern drawn on the surface of the recording paper P2, but also by irregularities of the surface of the recording paper P2, which exists even in a normal white paper, paper fiber pattern, wild formation, or the like.

The image sensor 805 is configured by disposing pixels each including an optoelectronic conversion device in a matrix shape, and a detection cycle of the image sensor 805 is set to, for example, 100 μs. The detection cycle of the image sensor 805 is suitably changeable depending on the type of paper, or the like, and is changeable, for example, to approximately 80 μs at the maximum. The reflected light from the recording paper P2 can be classified into specular reflection component and diffuse reflection component. Therefore, an irradiation direction of the light from the light emitting unit 801 with respect to the recording paper P2 is tilted by an incidence angle θ (for example, 16 degrees) with respect to a normal direction of the recording paper P2, and a light receiving direction of the light receiving unit 802 is matched with the normal direction of the recording paper P2, thereby ensuring that the light receiving unit 802 is capable of receiving the diffusion reflection component.

When the recording paper detection unit 800 is a laser type sensor, the light emitting unit 801 houses therein a laser diode as the light source 803, and the light receiving unit 802 receives an interference fringe pattern of laser beam due to the irregularities of the surface of the recording paper P2, or the like. The interference fringe pattern is to be formed due to the fact that minute irregularities of the surface of the recording paper P2 produces a difference between the surface of the recording paper P2 and the light receiving unit 802, thereby causing a phase difference in diffuse lights to be reflected from individual positions of the detection region B1 on the recording paper P2. The interference fringe pattern is also to be formed not only by the irregularities of the surface of the recording paper P2 but also by the paper fiber pattern, the wild formation, or the like.

Figures 6A, 6B:
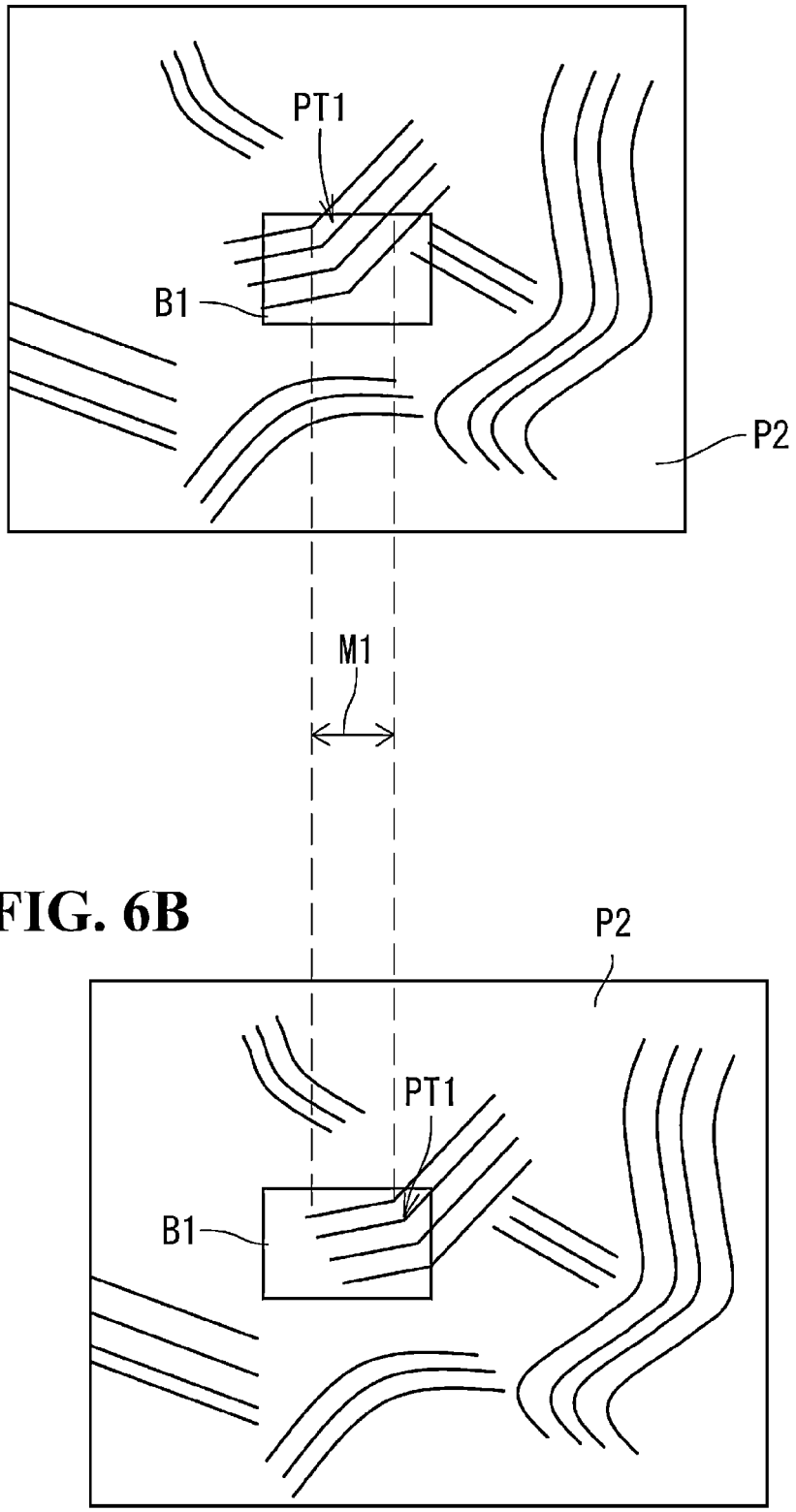
FIG. 6(A) and FIG. 6(B) are diagrams showing a method for calculating an amount of movement of a recording paper based on a measurement result obtained with the recording paper detection unit in FIG. 4.

The control unit 10 (or the conveyance control unit 118) receives the electrical signal (image signal) serving as the detection signal to be outputted from the recording paper detection unit 800 in every detection cycle of the image sensor 805, and calculates the amount of movement or moving velocity (conveyance velocity) of the recording paper P2 based on a difference between the electrical signals in the adjacent cycles. That is, the control unit 10 (or the conveyance control unit 118) receives a detection signal Sn as shown in FIG. 6(A) from the recording paper detection unit 800 by an n-th detection operation, and thereafter receives a detection signal Sn+1 as shown in FIG. 6(B) from the recording paper detection unit 800 by an (n+1)th detection operation. The control unit 10 (or the conveyance control unit 118) then compares the detection signals Sn and Sn+1, and computes an amount of movement M1 of the same pattern (brightness pattern or interference fridge pattern) PT1, thereby calculating the amount of movement or the moving velocity (conveyance velocity) of the recording paper P2.

The recording paper detection unit 800 may be configured by a laser Doppler velocimeter in place of the foregoing configuration. That is, the moving velocity of the recording paper P2 may be measured using so-called Doppler effect in which the frequency of a measuring wave from the recording paper P2 shifts in proportion to the moving velocity. When configured by the laser Doppler velocimeter, the recording paper detection unit 800 irradiates two irradiation lights to front and rear positions in the direction of velocity of the recording paper P2, and the same light receiving unit receives diffuse lights respectively reflected from the front and rear irradiation positions so as to detect the moving velocity (conveyance velocity) of the recording paper P2. The diffuse lights received by the light receiving unit contain therein velocity information about the recording paper P2 in the form of an optical wavelength change. The diffuse lights respectively from the irradiation lights are changed in a direction toward a shorter wavelength on the front side and a direction toward a longer wavelength on the rear side. The recording paper detection unit 800 detects a velocity by subjecting a difference in their respective wavelengths to heterodyne detection, and outputs the velocity to the control unit 10 or the conveyance control unit 118.

Figure 7:
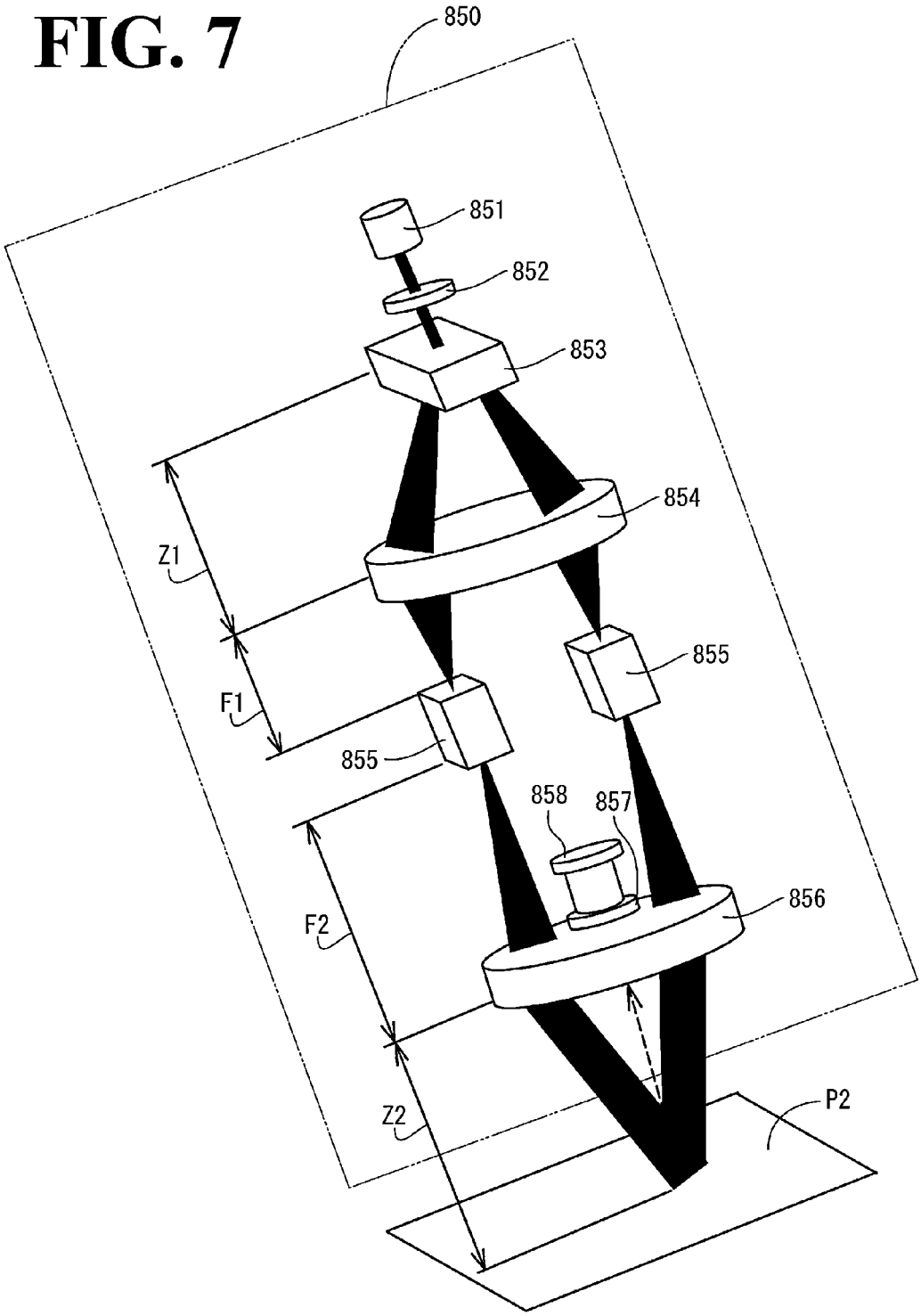
FIG. 7 is a schematic diagram showing a structure of a laser Doppler velocimeter to be used as a recording paper detection unit in the image forming apparatus according to the embodiment of the present invention.

An embodiment of the structure of the laser Doppler velocimeter is shown in FIG. 7. With the laser Doppler velocimeter 850 shown in FIG. 7, a laser beam emitted from a semiconductor laser 851 is divided into two beams by a diffraction grating 853, and these two beams are used for measuring. Also with the laser Doppler velocimeter 850, a predetermined frequency difference (frequency modulation) is applied to between these two beams by using an electro-optic element 855 constituting a frequency shifter, and Doppler effect based on the frequency difference is used to detect the velocity information about the recording paper P2 with high precision.

The laser light source 851 is disposed so that the laser beam (luminous flux) to be emitted becomes linearly polarized light with respect to Z-axis (a skew direction oriented perpendicularly to the conveyance direction of the recording paper P2) in FIG. 7. The laser beams from the semiconductor laser 851 become parallel fluxes by a collimator lens 852 and perpendicularly enter the transmission diffraction grating 853 in the grating alignment direction thereof. Of diffraction lights passing through the diffraction grating 853, two diffraction lights of +n-order and −n-order other than a zero-order (n is an integer of 1 or more) are emitted toward the electro-optic element 855 at a predetermined diffraction angle. The two diffraction lights from the diffraction grating 853 respectively enter an incident end face of each electro-optic element 855 through a focal optical system 854 that is an optical distance Z1 away from the diffraction grating 853. For example, a thin convex lens having a predetermined focal distance F1 is used as the focal optical system 854.

Each of the electro-optic elements 855 is configured by a flat plate of electro-optic crystal, and is disposed so as to have an optical axis on Y-axis. An electro-optic frequency shifter is configured upon application of a ramp voltage to electrodes disposed on opposite end faces located in the Y-axis direction. Accordingly, the two optical fluxes that have entered each electro-optic element 855 is to be subjected to frequency shift by ramp voltage drive (serrodyne drive), and therefore the two optical fluxes are allowed to enter an adaptive optical system 856 with a frequency difference applied between the two optical fluxes.

The adaptive optical system 856 allows the two optical fluxes having the frequency difference to be polarized at a predetermined angle and, at the same time, brought into parallel optical fluxes, and then emitted to the surface of the recording paper P2 moving in X direction at a position spaced apart by an optical distance Z2. The two optical fluxes emitted from the adaptive optical system 856 enter the surface of the recording paper P2 from two directions so as to intersect each other at a predetermined incident angle θ. For example, a thin film convex lens having a predetermined focal distance F2 is used as the adaptive optical system 856. The two optical fluxes brought into the parallel optical fluxes are to be emitted from the adaptive optical system 856 by making setting so that an optical distance between an emission end face of the electro-optic element 855 and the adaptive optical system 856 is the focal distance F2.

A photodetector 858 made up of a photo diode and the like is disposed at a position that is opposite to the recording paper P2 with the adaptive optical system 856 interposed therebetween. Scattered lights occur from the entered two optical fluxes having the frequency difference on the surface of the recording paper P2, and the scattered lights from the recording paper P2 enter the photodetector 858 via the adaptive optical system 856 and a collecting lens 857. The collecting lens 857 is configured by a condenser lens. Optical signals (scattered lights) containing a Doppler signal are efficiently collected into the photodetector 858 by the adaptive optical system 856 and the collecting lens 857.

That is, the two optical fluxes allowed to enter the recording paper P2 generate scattered lights after being subjected to the Doppler shift in proportion to the moving velocity V of the recording paper P2 so as to allow the scattered lights to enter the photodetector 858. Therefore, the scattered lights interfere with each other on a detection surface of the photodetector 858, thus producing a brightness change. When the two optical fluxes having a frequency difference fR due to laser beam having a wavelength λ are allowed to enter the recording paper P2, a brightness frequency (Doppler frequency) DF in the photodetector 858 can be calculated by equation (1).

$$DF=2\times V\times\sin\theta/\lambda+fR \quad \text{equation (1)}$$

(DF: Doppler frequency, V: conveyance velocity, λ: wavelength of laser beam, fR: frequency difference between two optical fluxes, and θ: incident angle)

Thus, the incorporation of the electro-optic frequency shifter using the electro-optic elements 855 ensures that the conveyance direction of the recording paper P2 and the moving velocity thereof can be measured by making setting so that the frequency difference fR is an appropriate value, even when the moving recording paper P2 has a low velocity V. The following relational expression of equation (2) is obtainable when an ±n-order optical flux to be emitted from the transmission diffraction grating 853 with a grating pitch d is an optical flux having a diffraction angle θ0.

$$\sin\theta 0=\pm n\times\lambda/d \quad \text{equation (2)}$$

(θ0: diffraction angle of θ0, λ: wavelength of laser beam, and d: grating pitch)

Here, assuming a certain correspondence relation is established between the incident angle θ of the ±n-order two optical fluxes into the recording paper P2 and the diffraction angle θ0, a basic composition DF0 of the Doppler frequency excluding the frequency difference fR is obtainable as one that is proportional only to the moving velocity V of the recording paper P2. Consequently, the Doppler frequency DF to be obtained with the photodetector 858 is also obtainable as one that is proportional only to the moving velocity V of the recording paper P2.

For example, when the ±n-order two optical fluxes are irradiated so that the incident angle θ is equal to the diffraction angle θ0, the basic component DF0 can be calculated from the equations (1) and (2) by equation (3), and the Doppler frequency DF to be obtained with the photodetector 858 can be calculated by equation (4).

$$DF0=2\times V\times\sin\theta 0/\lambda=2\times n\times V/d \quad \text{equation (3)}$$

$$DF=2\times n\times V/d+fR \quad \text{equation (4)}$$

(DF0: Doppler frequency excluding fR, DF: Doppler frequency, V: conveyance velocity, λ: wavelength of laser beam, d: grating pitch, and fR: frequency difference between two optical fluxes)

With the configuration shown in FIG. 7, a measurement is made by dividing the laser beam emitted from the laser light source 851 into the two beams by the diffraction grating 853. Hence, the measurement result thereof is unaffected by the change of wavelength λ in the laser beams. Accordingly, the laser light source 851 can be configured by the semiconductor laser element in which the wavelength λ in the laser beams has temperature dependence. That is, the conveyance velocity V of the recording paper P2 can be measured with high accuracy even when the inexpensive ultra-compact laser diode that is easy to drive is used for the laser light source 851.

Figure 8:
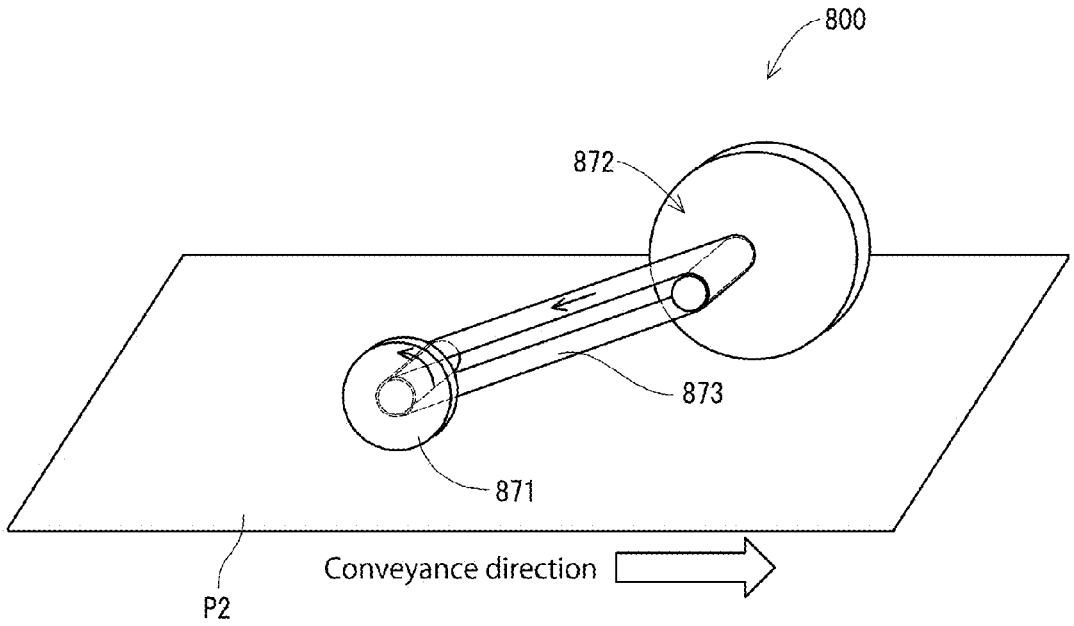
FIG. 8 is a schematic diagram showing a structure of a contact type sensor to be used as the recording paper detection unit in the image forming apparatus according to the embodiment of the present invention.

Alternatively, the recording paper detection unit 800 may be configured by a contact type sensor to be brought into contact with the recording paper P2. That is, the contact type sensor is brought into contact with the recording paper P2 so as to measure the amount of movement (the amount of conveyance) of the recording paper P2, thereby measuring the moving velocity of the recording paper P2. When configured by the contact type sensor, as shown in FIG. 8, the recording paper detection unit 800 includes, for example, a movement quantity detection roller 871 to be rotated upon contact with the surface of the recording paper P2, a potentiometer 872 to output a rotational angle as an electric signal, and a belt 873 to couple both rotary shafts of the detection roller 871 and the potentiometer 872. The belt 873 thus entrained therearound ensures that the detection roller 871 and the potentiometer 872 are rotatably coupled to each other.

With the recording paper detection unit 800 having the configuration shown in FIG. 8, the detection roller 871 in contact with the recording paper P2 is rotated as the recording paper P2 is moved (conveyed). The potentiometer 872 is rotated in conjunction with the rotation of the detection meter 871, so that the rotational angle of the potentiometer 872 is output as an electric signal. The recording paper detection unit 800 employing the contact type sensor may employ an encoder in place of the potentiometer 872, or may omit the detection roller 871. The recording paper detection unit 800 will not be limited to the foregoing configurations. In an alternative embodiment, a reflection type sensor may be disposed on an array.

The recording paper detection unit 800 may be one that performs analog output of the measurement result thereof by a physical quantity, such as voltage value and current value, or performs digital output by digital values in multi-gradation. When the recording paper detection unit 800 measures and outputs the conveyance velocity of the recording paper P2, the measurement result thereof is used for calculating conveyance delay information described later. when the recording paper detection unit 800 measures and outputs the amount of movement (amount of conveyance) of the recording paper P2, the amount of movement as the measurement result is divided by measuring time so as to obtain a conveyance velocity and calculate conveyance delay information. When the recording paper detection unit 800 measures and outputs the position of the conveyed recording paper P2, a difference from the previous measuring position is obtained, and the result is divided by measuring interval time so as to obtain a conveyance velocity and calculate conveyance delay information. In the calculation of the conveyance delay information, scale and offset are appropriately adjusted in advance between parameters used in the calculations.

Image forming apparatuses according to several embodiments according to the embodiment of the present invention are described below with reference to the drawings. The above configurations and operations are common to these image forming apparatuses of these embodiments, and their respective characteristic features are described in detail in the following embodiments.

<First Embodiment>

Figure 9:
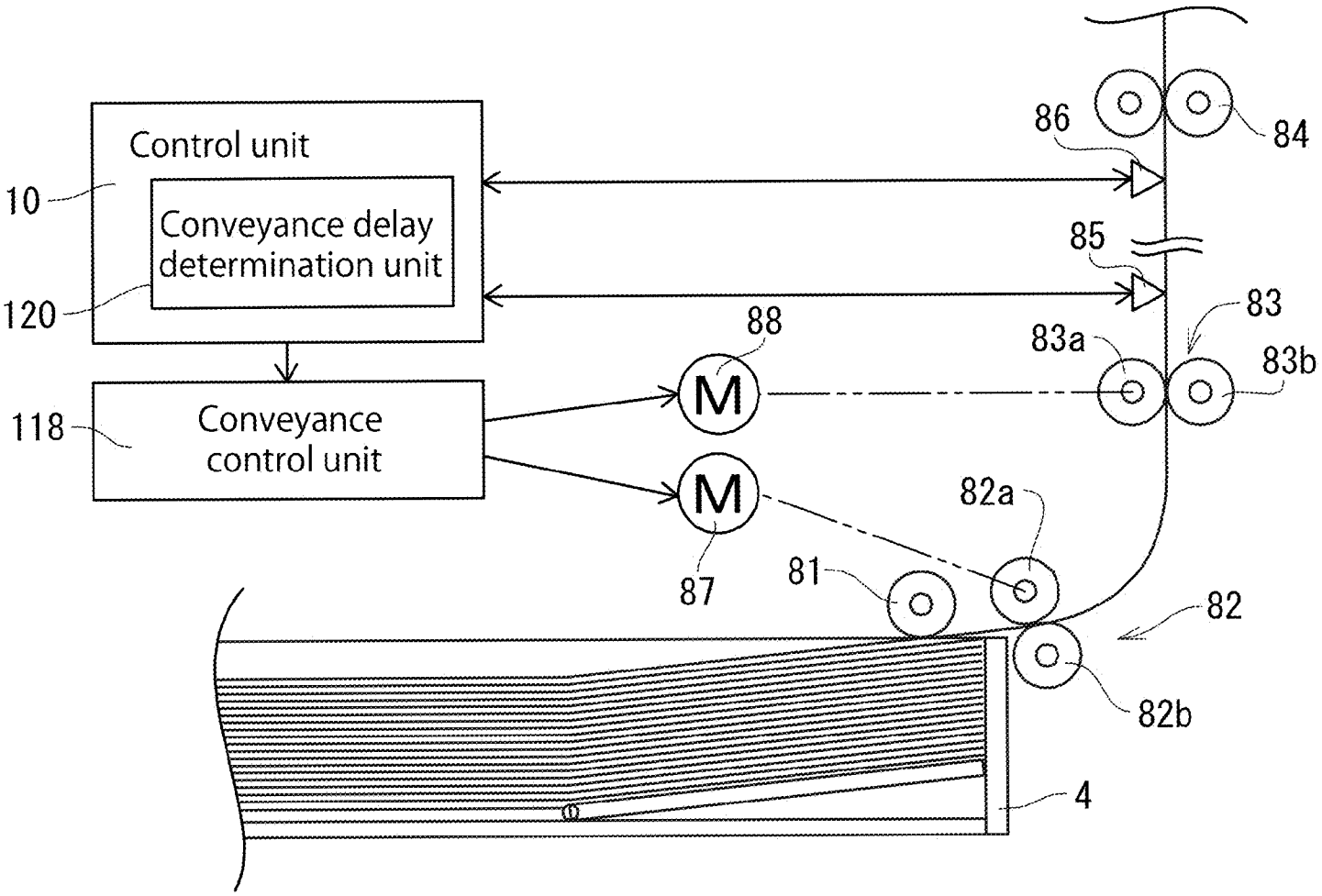
FIG. 9 is a schematic diagram showing a structure of a conveyance device in an image forming apparatus according to each of embodiments according to the embodiment of the present invention.
Figure 10:
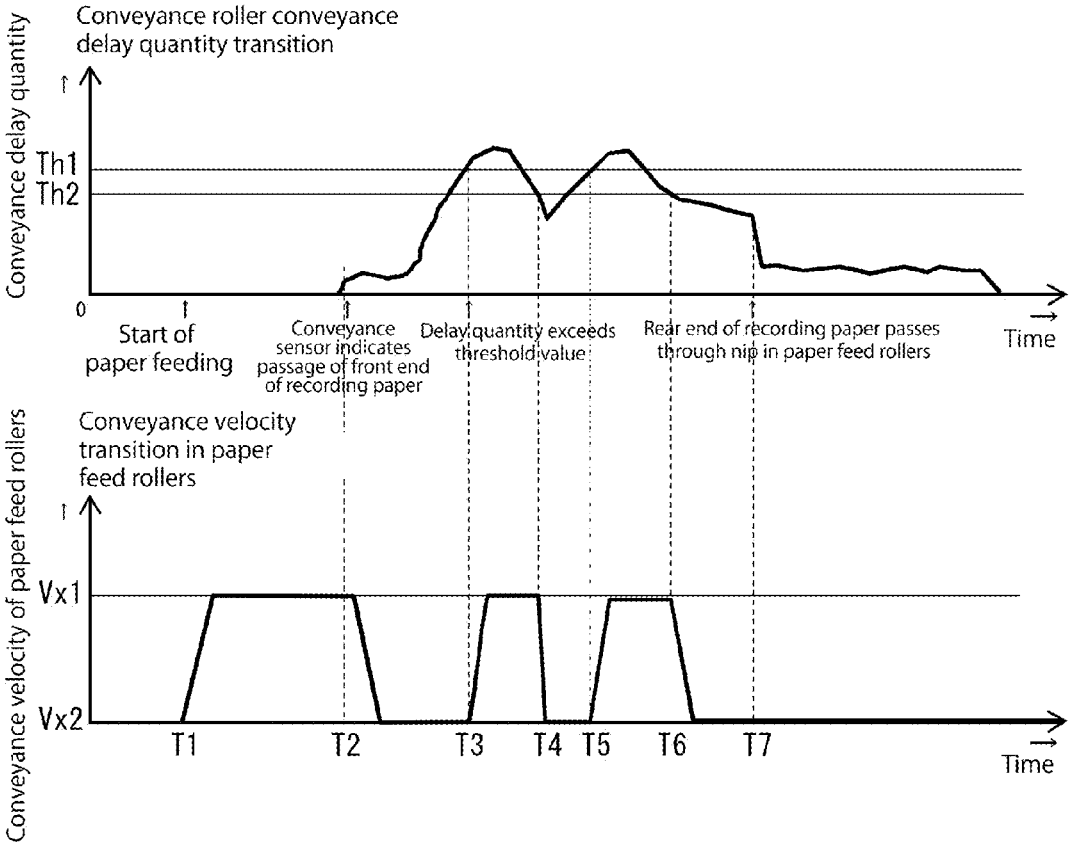
FIG. 10 is a timing chart showing a recording paper conveyance operation by the conveyance device in the image forming apparatus according to a first embodiment.
Figure 11:
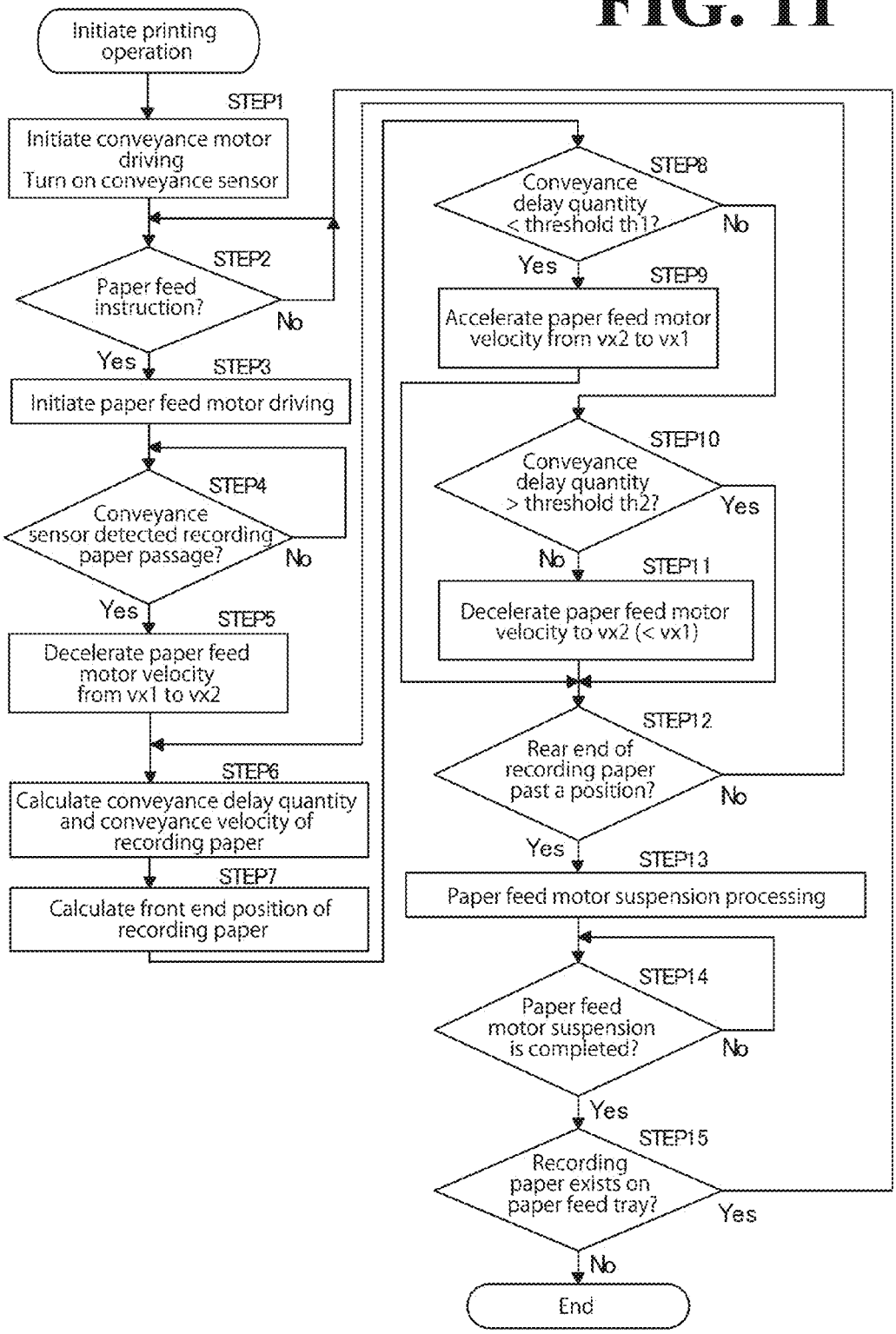
FIG. 11 is a flow chart showing a control operation for a recording paper conveyance performed by the image forming apparatus according to the first embodiment.

The first embodiment of the present invention will be described below with reference to the drawings. FIG. 9 is a schematic diagram showing a structure of a conveyance device in the image forming apparatus according to the present embodiment. FIG. 10 is a timing chart showing a recording paper conveyance operation by the conveyance device in the image forming apparatus of the present embodiment. FIG. 11 is a flow chart showing a control operation for the recording paper conveyance performed by the image forming apparatus of the present embodiment.

As shown in FIG. 9, the conveyance device in the image forming apparatus 1 of the present embodiment includes a pair of paper feed rollers 82, a pair of conveyance rollers 83, and a pair of timing rollers 84, which are sequentially disposed from the upstream side in a conveyance direction of the recording paper P2 along a main conveyance path R0. In the conveyance device, a conveyance sensor 85 is disposed on the downstream side of the pair of paper feed rollers 82, and a pre-timing sensor 86 is disposed on the upstream side of the pair of timing rollers 84. That is, the conveyance sensor 85 and the pre-timing sensor 86 are sequentially disposed from the upstream side in the conveyance direction so as to be located between the pair of paper feed rollers 82 and the pair of timing rollers 84 on the main conveyance path R0.

As shown in FIG. 9, a conveyance control unit 118 applies a control signal to each of a paper feed motor 87 and a conveyance motor 88 so as to control their respective rotational velocities of the paper feed motor 87 and the conveyance motor 88. A rotating shaft of the paper feed motor 87 is coupled to a rotating shaft of a drive roller 82*a* of the pair of paper feed rollers 82, and the drive roller 82*a* rotationally drives in conjunction with the rotation of the paper feed motor 87. A rotating shaft of the conveyance motor 88 is coupled to a rotating shaft of a drive roller 83*a* of the pair of paper conveyance rollers 83, and the drive roller 83*a* rotationally drives, interlocking with the rotation of the conveyance motor 88. The pair of paper feed rollers 82 and the pair of conveyance rollers 83 respectively include driven rollers 82*b* and 83*b* on the opposite side of the drive rollers 82*a* and 83*a* with the main conveyance path R0 interposed therebetween. The driven rollers 82*b* and 83*b* are rotationally driven in conjunction with the movement of the recording paper P2 to be conveyed by the rotations of the drive rollers 82*a* and 83*a*.

A conveyance sensor 85 measures a position or moving velocity of the recording paper P2 that has passed through between the pair of conveyance rollers 83, and transmits a measurement signal thereof to a control unit 10. The pre-timing sensor 86 detects the front end of recording paper P2 conveyed immediately before the pair of timing rollers 84 by the pair of conveyance rollers 83, and transmits a measurement signal thereof to the control unit 10. Upon receipt of the measurement signals from the conveyance sensor 85 and the pre-timing sensor 86, the control unit 10 generates a conveyance instruction signal based on these measurement signals, and applies the signal to the conveyance control unit 118. Based on the instruction signal from the control unit 10, the conveyance control unit 118 controls the rotational drives of the paper feed motor 87 and the conveyance motor 88. In order to reduce slip rate irrespective of the kind of the recording paper P2, a rotational velocity of the pair of paper feed rollers 82 that rotationally drives by the paper feed motor 87 is set higher than a rotational velocity of the pair of conveyance rollers 83 that rotationally drives by the conveyance motor 88.

With the conveyance device thus configured, when the recording paper P2 is fed to the main conveyance path R0 by the rotations of a delivery roller 81 and the pair of paper feed rollers 82, the conveyance sensor 85 monitors arrival of the recording paper P2 to the vicinity of the pair of conveyance rollers 83. Therefore, based on the measurement signal from the conveyance sensor 85, the control unit 10 detects whether the recording paper P2 arrives in the vicinity of the pair of conveyance rollers 83 in a predetermined period of time after feeding the recording paper P2. Upon detection of the front end of the recording paper P2 by the conveyance sensor 85, the control unit 10 causes the conveyance control unit 118 to change the rotational velocity of the pair of paper feed rollers 82 to a low velocity (including suspension) so as to suspend excessive feed of the recording paper P2 by the pair of paper feed rollers 82, thereby preventing paper folding or the like on the main conveyance path R0.

Similarly, after feeding the recording paper P2, the conveyance device allows the pre-timing sensor 86 to monitor arrival of the recording paper P2 to the near side of the pair of timing rollers 84. Therefore, based on the measurement signal from the pre-timing sensor 86, the control unit 10 detects whether the recording paper P2 arrives at the near side of the pair of timing rollers 84 in a predetermined period of time after feeding the recording paper P2. When the front end of the recording paper P2 is not detected even after the predetermined period of time has passed after feeding the recording paper P2, the control unit 10 determines occurrence of timer jam and cause a printing operation to be suspended.

In the conveyance device of the present embodiment, the conveyance sensor 85 as a recording paper detection unit 800 measures the conveyance velocity of the recording paper P2 and applies the conveyance velocity to the control unit 10 as described above. That is, after the front end of the recording paper P2 passes through between the pair of conveyance rollers 83, the conveyance sensor 85 indicates the conveyance velocity of the recording paper P2 passing through between the pair of conveyance rollers 83 to the control unit 10. As shown in FIG. 9, the control unit 10 also includes a conveyance delay determination unit 120, and the measurement signal obtained with the conveyance sensor 85 is to be input to the conveyance delay determination unit 120.

The conveyance delay determination unit 120 is to calculate conveyance delay information about the recording paper P2 by comparing the conveyance velocity (measured conveyance velocity) of the recording paper P2 obtainable from the measured signal obtained with the conveyance sensor 85 and a previously set and stored reference velocity (designed conveyance velocity). Based on the conveyance delay information, the control unit 10 determines a conveyance delay of the recording paper P2 passing through between the pair of conveyance rollers 83, and causes the conveyance control unit 118 to control the paper feed motor 87 so as to control the rotational drive of the pair of paper feed rollers 82 depending on the conveyance delay of the recording paper P2.

The conveyance delay information to be calculated by the conveyance delay determination unit 120 may be, for example, a velocity delay quantity D1 of conveyance velocity obtained by the following equation (5), a conveyance slip rate D2 obtained by the following equation (6), or a movement (conveyance) delay quantity D3 per unit time obtained by the following equation (7).

$$[\text{Velocity Delay Quantity } D1] = V0 - V \quad \text{equation (5)}$$

$$[\text{Conveyance Slip Rate } D2] = (V0 - V)/V0 \quad \text{equation (6)}$$

$$[\text{Movement Delay Quantity } D3] = M0 - M \quad \text{equation (7)}$$

(V0: designed conveyance velocity, V: measured conveyance velocity, M0: preset movement (conveyance) quantity per unit time)

A rotation control operation to the pair of paper feed rollers 82 will be described below with reference to the timing chart of FIG. 10 and the flow chart of FIG. 11. When the printing operation is initiated, the control unit 10 causes the conveyance control unit 118 to drive the conveyance motor 88 and rotate the pair of conveyance rollers 83, and also causes the conveyance sensor 85 to turn on and bring the conveyance state of the recording paper P2 into a measurable state (STEP 1).

Then, the control unit 10 applies a paper feed instruction to the conveyance control unit 118 (Yes in STEP 2), and the conveyance control unit 118 causes the paper feed motor 87 to drive to rotate the delivery roller 81 and the pair of paper feed rollers 82 (STEP 3). Upon this, the recording paper P2 of the uppermost layer in the paper feed tray 4 is delivered by the delivery roller 81 and, at the same time, is fed to the main conveyance path R0 by the pair of paper feed rollers 82. That is, as shown in FIG. 10, when the paper feed motor 87 is rotated to initiate paper feeding at time T1, the rotational velocity of the pair of paper feed rollers 82 is increased to a first rotational velocity Vx1.

After initiating the paper feeding of the recording paper P2, the control unit 10 indicates the passage of the front end of the recording paper P2 through between the pair of conveyance rollers 83 (Yes in STEP 4) based on the measurement signal from the conveyance sensor 85, the conveyance control unit 118 reduces the rotational velocity of the paper feed motor 87 (STEP 5). At this time, the rotational velocity of the pair of paper feed rollers 82 is reduced from the first rotational velocity Vx1 to a second rotational velocity Vx2 ($0 \leq Vx2 < Vx1$). In the embodiment shown in FIG. 10, when the conveyance sensor 85 indicates the passage of the front end of the recording paper P2 at time T2, the paper feed motor 87 is suspended so as to suspend (reduce) the rotation of the pair of paper feed rollers 82.

After the rotational velocity of the paper feed motor 87 is reduced as described above, the control unit 10 causes the conveyance delay determination unit 120 to calculate the conveyance delay quantity of the recording paper P2 based on the measurement signal from the conveyance sensor 85 (STEP 6). At this time, the conveyance delay determination unit 120 calculates the conveyance delay quantity of the recording paper P2 and the conveyance velocity of the recording paper P2. Then, the control unit 10 integrates the conveyance velocity of the recording paper P2 that has been measured by the conveyance sensor 85, thereby calculating a relative position between the conveyance sensor 85 and the front end of the recording paper P2 on the main conveyance path R0 (a front end position of the recording paper P2) (STEP 7).

After the recording paper P2 passes through between the pair of conveyance rollers 83, the control unit 10 compares the conveyance delay quantity of the recording paper P2 and a threshold Th1 based on the conveyance delay information obtained with the conveyance delay determination unit 120 (STEP 8). When the conveyance delay quantity of the recording paper P2 based on the measurement result obtained with the conveyance sensor 85 exceeds the threshold Th1 (Yes in STEP 8), the control unit 10 accelerates the rotational velocity of the paper feed motor 87 (STEP 9). At this time, the rotational velocity of the pair of paper feed rollers 82 increases from the second rotational velocity Vx2 to the first rotational velocity Vx1 (see times T3 and T5 in the embodiment of FIG. 10).

Thus, when the conveyance delay quantity of the recording paper P2 exceeds the threshold Th1 and reaches an unacceptable level of delay (for example, immediately before reaching such a delay quantity as to cause a jam due to a delay of paper), the paper feed motor 87 is accelerated. By accelerating the paper feed motor 87, a driving force to conveyance the recording paper P2 is generated in the pair of paper feed rollers 82, thereby preventing the pair of paper feed rollers 82 from being subjected to a load under which the pair of paper feed rollers 82 are driven, and to a frictional load with respect to the subsequent paper. Consequently, a slip between the pair of conveyance rollers 83 is eliminated to recover the conveyance velocity of the recording paper P2. Additionally, the pair of paper feed rollers 82 are driven at a higher velocity than the pair of conveyance rollers 83 so as to generate a slack of the recording paper P2 between the pair of conveyance rollers 83 and the pair of paper feed rollers 82. Therefore, the slip can also be eliminated by eliminating the frictional load between the main conveyance path R0 and the recording paper P2.

When the conveyance delay quantity of the recording paper P2 is the threshold Th1 or less (No in STEP 8), the control unit 10 compares the conveyance delay quantity of the recording paper P2 and the threshold Th2 ($0 < Th2 \leq Th1$) based on the conveyance delay information obtained with the conveyance delay determination unit 120 (STEP 10). When the conveyance delay quantity of the recording paper P2 based on the measurement result obtained with the conveyance sensor 85 is less than the threshold Th2 (No in STEP 10), the control unit 10 sets the rotational velocity of the paper feed motor 87 to the same velocity as the rotational velocity in STEP 5 (STEP 11). Accordingly, when the rotational velocity of the paper feed motor 87 is accelerated depending on the measurement value obtained with the conveyance sensor 85 at the previous measurement timing, the rotational velocity of the paper feed motor 87 is decelerated to the rotational velocity before the rotational velocity of the paper feed motor 87 is accelerated, by the control operations in STEP 10 and STEP 11. That is, as shown at times T4 and T6 in the embodiment of FIG. 10, the rotational velocity of the pair of paper feed rollers 82 is reduced from the first rotational velocity Vx1 to the second rotational velocity Vx2.

When the conveyance delay quantity of the recording paper P2 is less than the threshold Th2 after the rotational velocity of the paper feed motor 87 is accelerated, the rotational velocity of the paper feed roller 86 is returned to the state before acceleration, thereby reducing power consumption of the driving source on the paper feed side (the paper feed motor 87, and the like). Meanwhile, the amount of slip is increased due to the drawing of the recording paper P2 from the paper feed tray 4, and hence the driving velocity by the paper feed motor 87 may be set slightly high as described above. Therefore, when continued in the state in which the rotational velocity of the paper feed motor 85 is accelerated, there is a risk that an excessive loop may be generated between the pair of conveyance rollers 83 and a paper wrinkle occurs on the recording paper P2. As the foregoing control operations in STEP 10 and STEP 11, when the conveyance delay quantity of the recording paper P2 is lower than the threshold Th2, the rotational velocity of the paper feed motor 87 is returned to the state before acceleration so as to prevent a side effect, such as paper folding of the recording paper P2 due to an increase in the amount of feeding by the pair of paper feed rollers.

When the conveyance delay quantity of the recording paper P2 based on the measurement result obtained with the conveyance sensor 85 is the threshold Th2 or more in STEP 10, or when the rotational velocity of the paper feed motor 87 is accelerated or decelerated in STEP 9 or 11, the control unit 10 determines whether the rear end of the recording paper P2 has passed through a predetermined position (for example, a position immediately before a nip region in the pair of paper feed rollers 82) based on the measurement result obtained with the conveyance sensor 85 (STEP 12). Here, after the conveyance sensor 85 detects the front end of the recording paper P2 (STEP 4), the control unit 10 obtains the front end position of the recording paper P2 based on a history of the measurement results in the conveyance sensor 85 (STEP 7), thereby estimating the rear end position of the recording paper P2 on the main conveyance path R0 from a paper length of the recording paper P2 along the conveyance direction and the front end position of the recording paper P2.

The control unit 10 repeats the control operations in STEPs 6 to 12 until a determination is made that the rear end of the recording paper P2 has passed through the predetermined position in STEP 12. That is, in the absence of a delay of the conveyance velocity of the recording paper P2 passing through between the pair of conveyance rollers 83 from when the front end of the recording paper P2 passes through between the pair of conveyance rollers 83 to when the rear end of the recording paper P2 passes through the near side of the pair of paper feed rollers 82, the rotational velocity of the pair of paper feed rollers 82 is decelerated to the first rotational velocity Vx1. On the occurrence of a delay of the conveyance velocity of the recording paper P2 passing through between the pair of conveyance rollers 83, the rotational velocity of the pair of paper feed rollers 82 is accelerated to the second rotational velocity Vx2.

In the control operations in STEPs 6 to 12, the threshold Th1 when the acceleration is carried out for the delay quantity and the threshold Th2 when returning to the state before the acceleration may be equal to each other. However, the thresholds Th1 and Th2 to be used as a rotational velocity change timing are preferably different from each other so as to have hysteresis. By allowing the thresholds Th1 and Th2 to have different values, during the drive control to the paper feed motor 87, it is configured to absorb variations in the measurement values obtained with the conveyance sensor 85 due to occurrence of variation, depending on the conveyance state of the recording paper P2 to be conveyed, measurement noise, or the like. This contributes to preventing the event that a rotational velocity change of the pair of paper feed rollers 82 occurs in succession in a short time. This also ensures a prolonged interval of the rotational velocity change of the paper feed motor 87, thereby suppressing sharp change of load on the pair of conveyance rollers 82, as well as velocity unevenness and noise due to the vibration.

When at determination is made that the rear end of the recording paper P2 has passed through the predetermined position (Yes in STEP 12), the control unit 10 applies a stop instruction to suspend the paper feed motor 87 to the conveyance control unit 118 so as to suspend the rotational drive of the paper feed motor 87 (STEP 13). When the rear end of the recording paper P2 passes through the nip region in the pair of paper feed rollers 82 at time T7 as in the embodiment in FIG. 10, the control unit 10 suspends the rotational drive of the paper feed motor 87 immediately before time T7. That is, the control unit 10 initiates suspension processing to the paper feed motor 87 immediately before an estimated rear end position of the recording paper P2 passes through between the pair of paper feed rollers 82. Here, timing of initiation of the suspension processing for the paper feed motor 87 is set immediately before the rear end position of the recording paper P2 passes through between the pair of paper feed rollers 82. Depending on the amount of slack of the recording paper P2, the timing may be set immediately after the passage of the pair of paper feed rollers 82, but the present invention will not be limited to the above-mentioned timing.

Thereafter, upon indication of the suspension of the rotational drive of the paper feed motor 87 (Yes in STEP 14), the control unit 10 indicates whether the recording paper P2 is stored in the paper feed tray 4 based on a signal from a sensor (not shown) included in the paper feed tray 4 (STEP 15). When no recording paper P2 is stored in the paper feed tray 4 (No in STEP 13), the control unit 10 terminates the control operation in order to indicate externally shortage of the recording paper P2 in the paper feed tray 4. When the recording paper P2, is stored in the paper feed tray 4, it proceeds to STEP 2.

<Second Embodiment>

Figure 12:
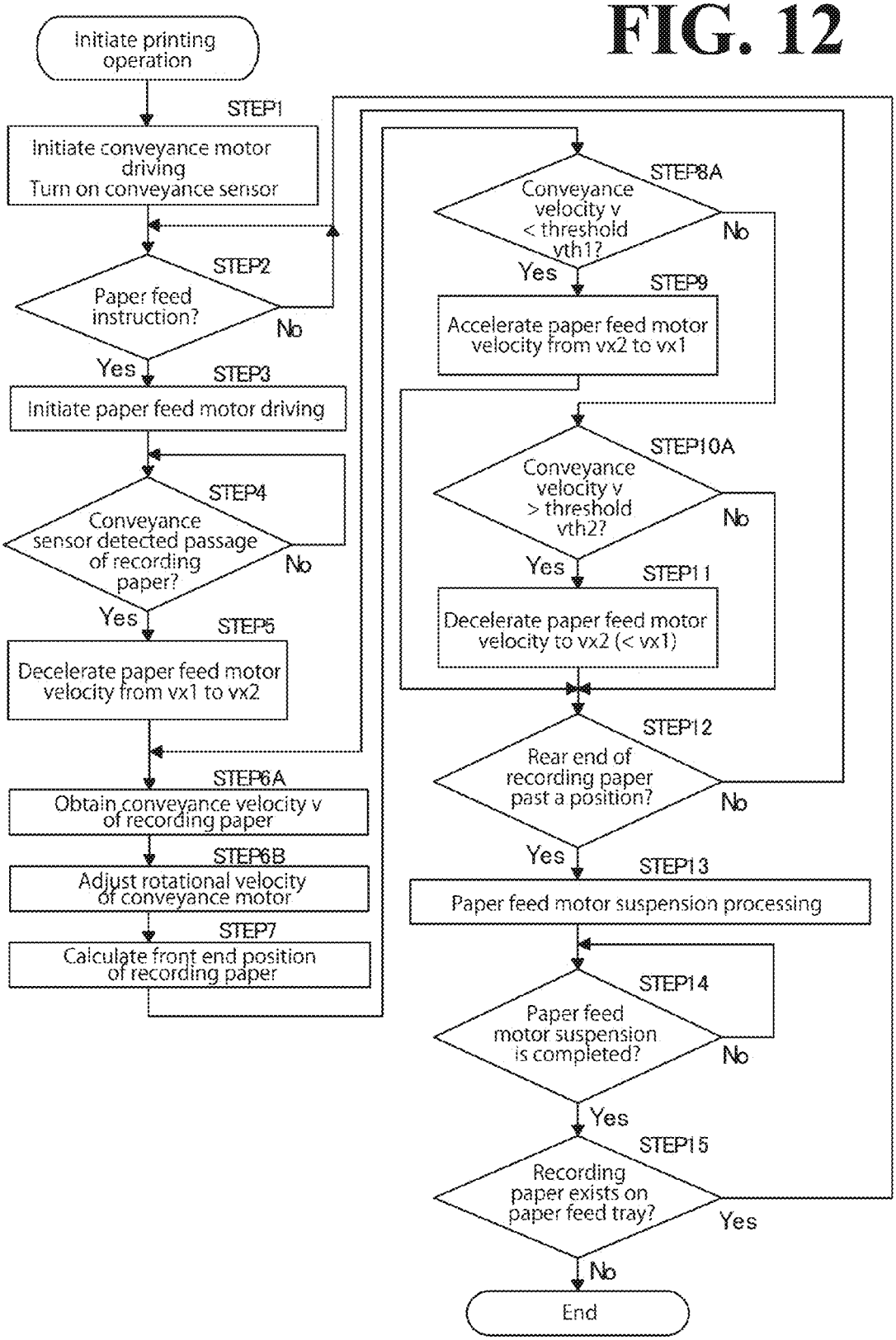
FIG. 12 is a flow chart showing a control operation for a recording paper conveyance performed by the image forming apparatus according to a second embodiment.

The second embodiment of the present invention will be described below with reference to the drawings. The structure of the image forming apparatus according to the present embodiment is similar to that of the first embodiment. Therefore, the details of the structure of the present embodiment is omitted here, and a control operation in the conveyance device will be described below. FIG. 12 is a flow chart showing the control operation to the conveyance device by the control unit in the image forming apparatus of the present embodiment. In the flow chart of FIG. 12, units identical to those in the flow chart of FIG. 11 are identified by the same reference numerals, and their respective detailed descriptions are omitted.

A rotation control operation to the pair of paper feed rollers 82 will be described below with reference to the flow chart of FIG. 12. When the control unit 10 initiates the printing operation, similarly to the first embodiment, the conveyance control unit 118 causes the conveyance motor 88 to be driven and causes the conveyance sensor 85 to be turned on. Then, the conveyance control unit 118 causes paper feed motor 87 to be driven according to the paper feed instruction of the control unit 10 (STEPs 1 to 3). When, after the drive of the paper feed motor 87 is initiated, the conveyance sensor 85 detects the front end of the recording paper P2 (Yes in STEP 4), the control unit 10 reduces the rotational velocity of the paper feed motor 86 (STEP 5).

In the present embodiment, after the rotational velocity of the paper feed motor 87 is decelerated (STEP 5), the conveyance delay determination unit 120 obtains a conveyance velocity V of the recording paper P2 based on the measurement signal from the conveyance sensor 85 (STEP 6A). Based on the conveyance velocity V of the recording paper P2 obtained by the conveyance delay determination unit 120, the control unit 10 calculates a correction value of the rotational velocity in the conveyance motor 88 and applies the correction value to the conveyance control unit 118. The conveyance control unit 118 adjusts the rotational velocity of the conveyance motor 88 so as to keep the conveyance velocity of the recording paper P2 constant (STEP 6B). Similarly to the first embodiment, the control unit 10 also integrates the conveyance velocity of the recording paper P2 and calculates a front end position of the recording paper P2 (STEP 7).

After the rotational velocity of the conveyance motor 88 is corrected as described above, the control unit 10 compares a conveyance velocity V of the recording paper P2 measured with the conveyance sensor 85 with a previously recorded threshold Vth1 of conveyance velocity (STEP 8A). When the measured conveyance velocity V of the recording paper P2 is lower than the threshold Vth1 (Yes in STEP 8A), the control unit 10 determines that a delay occurs in the conveyance velocity of the recording paper P2, and accelerates the rotational velocity of the paper feed motor 87 so as to accelerate the rotational velocity of the pair of paper feed rollers 82 to a first rotational velocity Vx1 (STEP 9).

When the conveyance velocity of the recording paper P2 is the threshold Vth1 or more (No in STEP 8A), the control unit 10 compares the measured conveyance velocity of the recording paper P2 with a previously recorded threshold Vth2 of the conveyance velocity (0<Vth1≤Vth2) (STEP 10A). When the measured conveyance velocity V is higher than the threshold Vth1 (Yes in STEP 10A), the control unit 10 sets the rotational velocity of the paper feed motor 87 to the same velocity as the rotational velocity in STEP 5, and the pair of paper feed rollers 82 are allowed to rotate at a second rotational velocity Vx2 (STEP 11). Therefore, when the rotational velocity of the paper feed motor 87 is accelerated based on the measured value with the conveyance sensor 85 at the previous measurement timing, a determination is made that the delay of the conveyance velocity of the recording paper P2 is eliminated by the control operations in STEPs 10A and 11. Accordingly, the rotational velocity of the pair of paper feed rollers 82 is decelerated from the first rotational velocity Vx1 to the second rotational velocity Vx2.

When the conveyance velocity V of the recording paper P2 is the threshold Vth2 or less, or when the rotational velocity of the paper feed motor 87 is accelerated or decelerated in STEP 9A or 9B, the control unit 10 determines whether the rear end of the recording paper P2 has passed through a predetermined position (STEP 12). In the absence of the passage of the rear end of the recording paper P2 (No in STEP 12), it proceeds to STEP 6A and the above control operations (STEPs 6A to 12) are repeated. On the occurrence of passage of the rear end of the recording paper P2 (Yes in STEP 12), the control unit 10 causes the paper feed motor 87 to be suspended, and indicates the presence or absence of the recording paper P2 in the paper feed tray 4 (STEPs 13 to 15).

<Third Embodiment>

Figure 13:
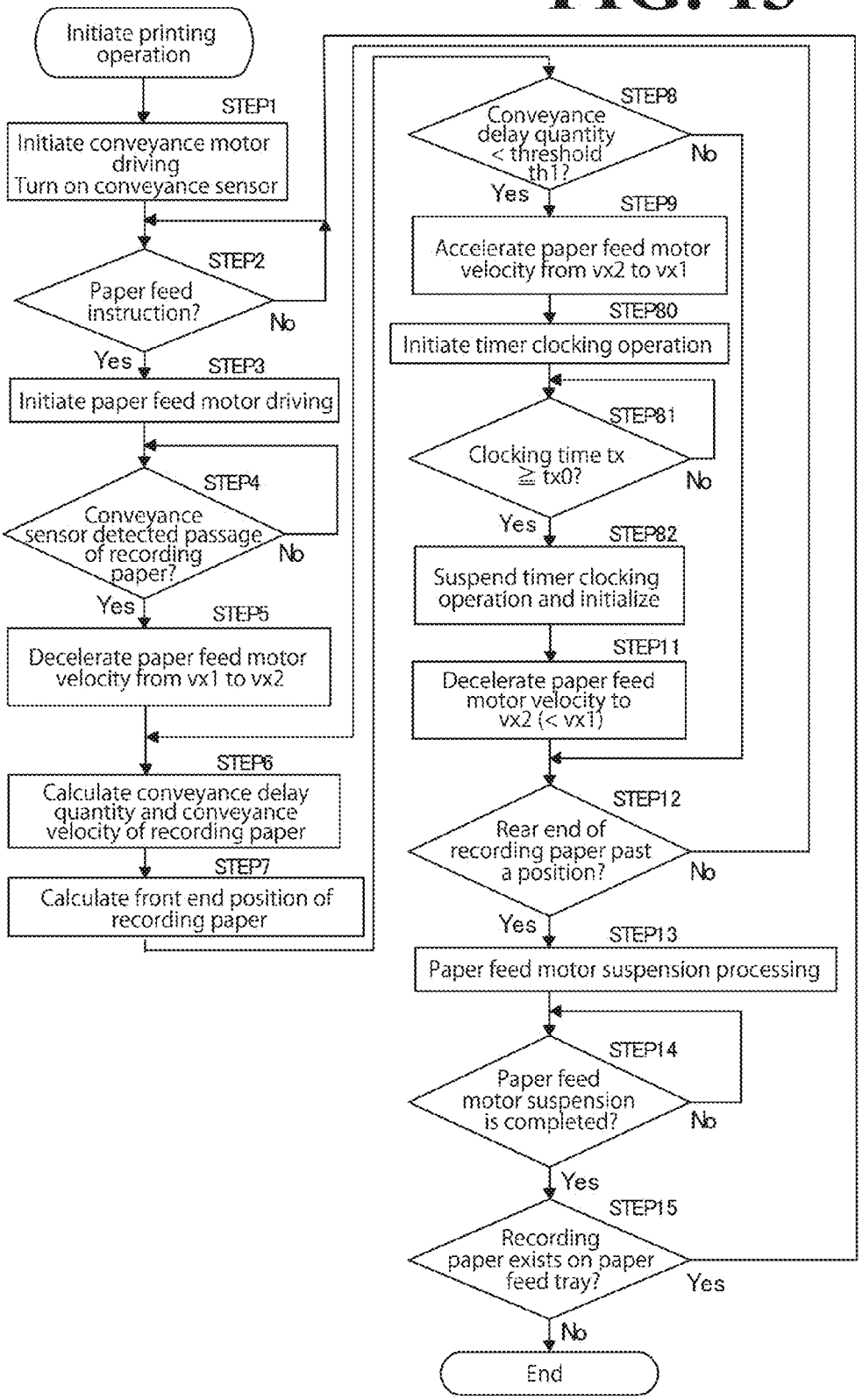
FIG. 13 is a flow chart showing a control operation for a recording paper conveyance performed by the image forming apparatus according to a third embodiment.

The third embodiment of the present invention will be described below with reference to the drawings. Similarly to the second embodiment, the structure of the image forming apparatus according to the present embodiment is similar to that of the first embodiment. FIG. 13 is a flow chart showing a control operation to a conveyance device by a control unit in the image forming apparatus of the present embodiment. In the flow chart of FIG. 13, units identical to those in the flow chart of FIG. 12 are identified by the same reference numerals, and their respective detailed descriptions are omitted.

A rotation control operation to the pair of paper feed rollers 82 will be described below with reference to the flow chart of FIG. 13. The present embodiment differs from the first embodiment in that, when a delay occurs in the conveyance velocity of the recording paper P2 after the recording paper P2 passes through between the pair of conveyance rollers 83, the rotational velocity of the paper feed motor 87 is accelerated by a predetermined period of time. The operations in STEPs 1 to 8 and STEPs 12 to 15, except for the steps related to acceleration operation to the paper feed motor 87, are similar to those in the first embodiment. Therefore, the operations in STEPs 8 to 12 in the flow chart of FIG. 13 are described below.

When the control unit 10 indicates that the conveyance delay quantity of the recording paper P2 exceeds the threshold Th1 (Yes in STEP 8), the control unit 10 determines that a delay occurs in the conveyance velocity of the recording paper P2, and accelerates the rotational velocity of the paper feed motor 87 so as to accelerate the rotational velocity of the pair of paper feed rollers 82 to the first rotational velocity Vx1 (STEP 9). Thereafter, the control unit 10 initiates a clocking operation with an unshown timer (STEP 80), and indicates the presence or absence of the passage of a predetermined period of time TX0 based on clocking time TX with the timer (STEP 81).

When the control unit 10 indicates that the clocking time TX with the timer reaches the predetermined period of time TX0 and the predetermined period of time TX0 has passed after accelerating the paper feed motor 87 (Yes in STEP 81), the control unit 10 suspends the clocking operation of the timer and initializes the clocking time (STEP 82). The control unit 10 indicates the passage of a predetermined period of time T10 and allows the timer to be reset. Then, the control unit 10 sets the rotational velocity of the paper feed motor 87 to the same velocity as the rotational velocity in STEP 5 so as to decelerate the rotational velocity of the pair of paper feed rollers 82 from the first rotational velocity Vx1 to the second rotational velocity Vx2 (STEP 11), and it proceeds to STEP 12.

<Fourth Embodiment>

Figure 14:
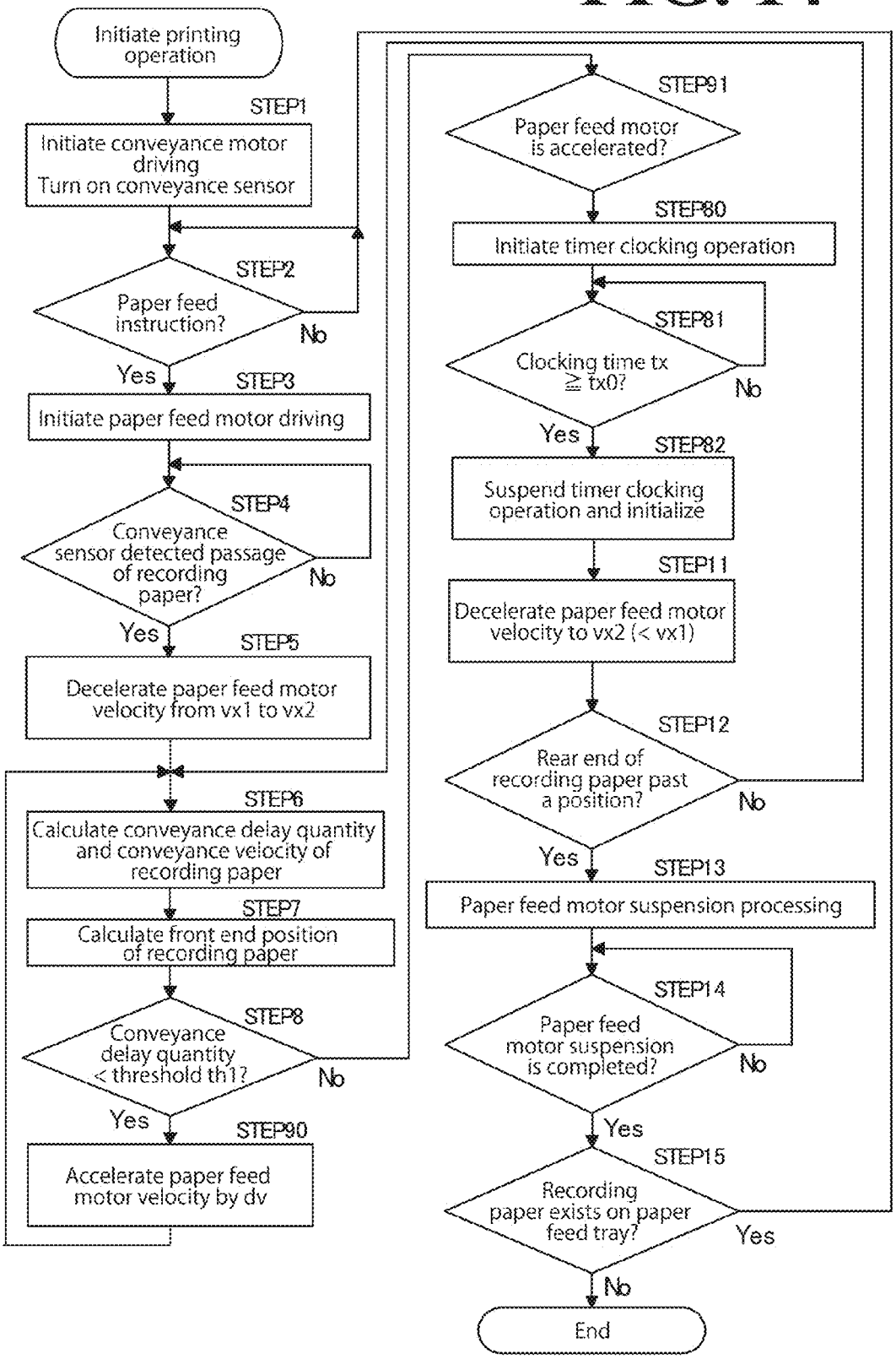
FIG. 14 is a flow chart showing a control operation for a recording paper conveyance performed by the image forming apparatus according to a fourth embodiment.

The fourth embodiment of the present invention will be described below with reference to the drawings. Similarly to the third embodiment, the structure of the image forming apparatus according to the present embodiment is similar to that of the first embodiment. FIG. 14 is a flow chart showing a control operation to a conveyance device by a control unit in the image forming apparatus of the present embodiment. In the flow chart of FIG. 14, parts identical to those in the flow chart of FIG. 13 are identified by the same reference numerals, and their respective detailed descriptions are omitted.

A rotation control operation to the pair of paper feed rollers 82 will be described below with reference to the flow chart of FIG. 14. The present embodiment differs from the third embodiment in that, when a delay occurs in the conveyance velocity of the recording paper P2 after the recording paper P2 passes through between the pair of conveyance rollers 83, the rotational velocity of the paper feed motor 87 is gradually accelerated until the delay in the conveyance velocity of the recording paper P2 is eliminated. The operations in STEPs 1 to 8 and STEPs 12 to 15, except for the steps related to the acceleration operation to the paper feed motor 87, are similar to those in the third embodiment. Therefore, the operations in STEPs 8 to 12 in the flow chart of FIG. 14 are described below.

When the control unit 10 indicates that the conveyance delay quantity of the recording paper P2 exceeds the threshold Th1 (Yes in STEP 8), the control unit 10 determines that a delay occurs in the conveyance velocity of the recording paper P2, and accelerates the rotational velocity of the paper feed motor 87 by a predetermined velocity dV (STEP 90), and it proceeds to STEP 6. That is, when the delay in the conveyance velocity of the recording paper P2 is detected in STEP 8, the operations in STEPs 6 to 90 are repeated until the delay in the conveyance velocity of the recording paper P2 is eliminated. Here, when the delay in the conveyance velocity of the recording paper P2 is eliminated after the operations in STEPs 6 to 90 are repeated N times, the rotational velocity of the paper feed motor 87 is to be accelerated by N×dV.

When the conveyance delay quantity of the recording paper P2 is the threshold Th1 or less (No in STEP 8), the control unit 10 determines that no delay occurs in the conveyance velocity of the recording paper P2, and indicates the presence or absence of the acceleration of the paper feed motor 87 in STEP 90 (STEP 91). When the rotational velocity of the paper feed motor 87 is accelerated (No in STEP 91), the control unit 10 initiates a clocking operation with an unshown timer, and indicates the passage of a predetermined period of time TX0. The control unit 10 then initializes the timer and also sets the rotational velocity of the paper feed motor 87 to the same velocity as the rotational velocity in STEP 5 (STEPs 80 to 82, and 11). When the rotational velocity of the paper feed motor 87 is not accelerated (Yes in STEP 91), it proceeds to STEP 12.

<Fifth Embodiment>

Figure 15:
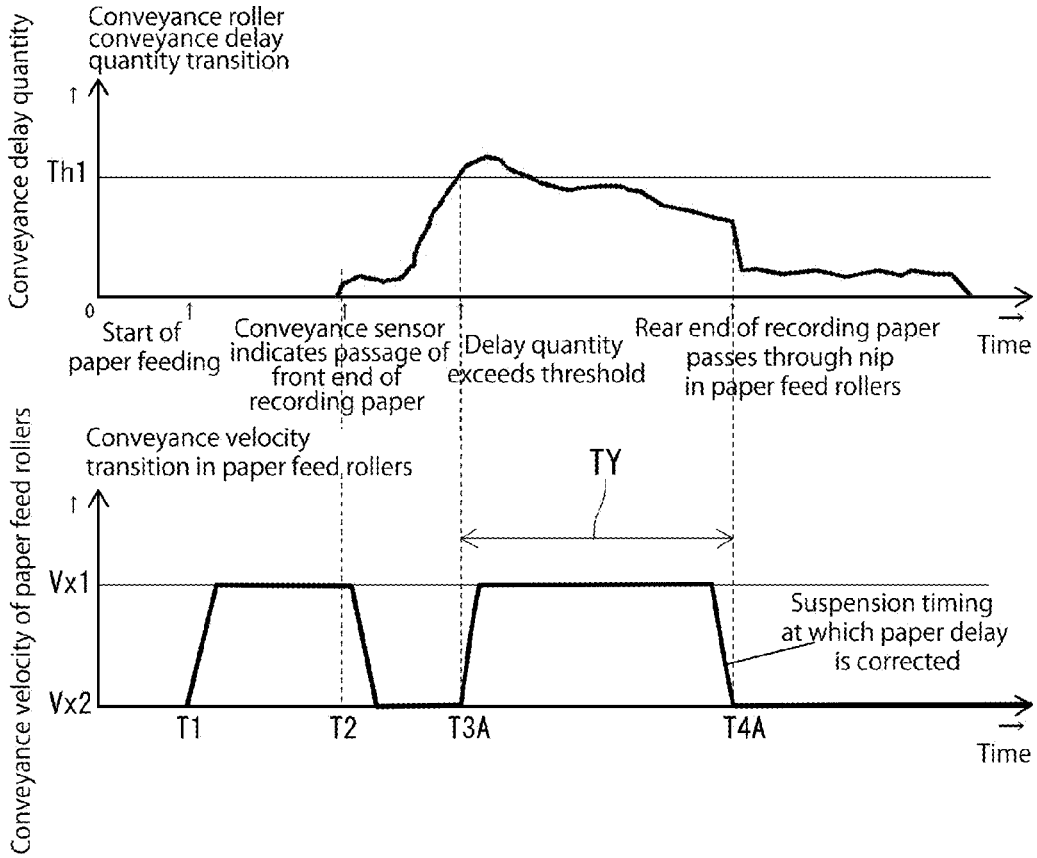
FIG. 15 is a timing chart showing a recording paper conveyance operation performed by the conveyance device in the image forming apparatus according to a fifth embodiment.

The fifth embodiment of the present invention will be described below with reference to the drawings. Similarly to the third embodiment, the structure of the image forming apparatus according to the present embodiment is similar to that of the first embodiment. FIG. 15 is a timing chart showing control operations to a conveyance device in the image forming apparatus of the present embodiment. In the timing chart of FIG. 15, units identical to those in the timing chart of FIG. 10 are identified by the same reference numerals, and their respective detailed descriptions are omitted.

A rotation control operation to the pair of paper feed rollers 82 will be described below with reference to the timing chart of FIG. 15. The present embodiment differs from the third and fourth embodiments in that, when a delay occurs in the conveyance velocity of the recording paper P2, a remaining conveyance length of the recording paper P2 is calculated, and the paper feed motor 87 is accelerated by a period of time corresponding to the remaining conveyance length. That is, with the present embodiment, when a delay occurs in the conveyance velocity of the recording paper P2, a period of time until the rear end of the recording paper P2 passes through a predetermined position (for example, a position immediately before a nip region in the pair of paper feed rollers 82) is calculated, and the paper feed motor 87 is accelerated for the calculated time.

In the embodiment of FIG. 15, when the feed of the recording paper P2 is initiated at time T1, the control unit 10 causes the conveyance control unit 118 to rotationally drive the pair of paper feed rollers 82 at the first rotational velocity Vx1. Thereafter, when the control unit 10 causes the conveyance sensor 85 to indicate the passage of the front end of the recording paper P2 through between the pair of conveyance rollers 83 at time T2, the control unit 10 causes the conveyance control unit 118 to decelerate the paper feed motor 87 so as to decelerate the rotational velocity of the pair of paper feed rollers 82 from the first rotational velocity Vx1 to the second rotational velocity Vx2 (a suspension state in the embodiment of FIG. 15). When the conveyance delay quantity of the recording paper P2 based on the measurement result obtained by the conveyance sensor 85 exceeds a threshold Th1, the control unit 10 causes the conveyance control unit 118 to accelerate the paper feed motor 87 so as to accelerate the rotational velocity of the pair of paper feed rollers 82 to the first rotational velocity Vx1 (time T3A in the embodiment of FIG. 15).

Upon detection of the occurrence of a delay in the conveyance of the recording paper P2, the control unit 10 indicates a conveyance position of the recording paper P2 based on a history of measurement results with the conveyance sensor 85 so as to calculate an amount of conveyance (the amount of movement of the recording paper P2) L1 by the pair of paper feed rollers 82. The mount of conveyance by the pair of paper feed rollers 82 can be calculated by, for example, adding a path length from the pair of paper feed rollers 82 to the conveyance sensor 85 to the amount of movement of the recording paper P2 after passing through the conveyance sensor 85. The control unit 10 is also capable of calculating a remaining amount of conveyance (L0−L1) until the rear end of the recording paper P2 passes through between the pair of paper feed rollers 82 by subtracting the amount of conveyance L1 from a conveyance direction length L0 of the recording paper P2.

Then, the control unit 10 calculates an acceleration term TY of the paper feed motor 87 by dividing the calculated remaining amount of conveyance (L0−L1) by the conveyance velocity obtained by the pair of paper feed rollers 82 (for example, the first rotational velocity Vx). The control unit 10 accelerates the paper feed motor 87 at time T3A, and maintains the accelerated state of the paper feed motor 87 until the passage of the acceleration term TY, thereby rotating the pair of paper feed rollers 82 at the first rotational velocity Vx. Thereafter, the rear end of the recording paper P2 passes through between the pair of paper feed rollers 82 at time T4A when the acceleration term TY has passed, and hence the control unit 10 suspends the paper feed motor 87.

In the foregoing third to fifth embodiments, acceleration and acceleration cancelling in the pair of paper feed rollers 82 are not repeated, thus contributing to preventing vibration and load change due to the acceleration and deceleration of the pair of paper feed rollers 82, and velocity unevenness due to the vibration and load change (image quality deterioration due to the vibration transmitted to an image formation system). In order to eliminate the occurrence of an excessive slack of the recording paper P2 in the range from the pair of paper feed rollers 82 and the conveyance roller 83, the conveyance velocity in the pair of paper feed rollers 82 during acceleration is more preferably settable so as not exceed the conveyance velocity at which, after the paper feed is initiated, the recording paper P2 is moved to the conveyance sensor 85 (at the same as or relatively higher than the conveyance velocity by the pair of conveyance rollers 83).

<Sixth Embodiment>

Figure 16:
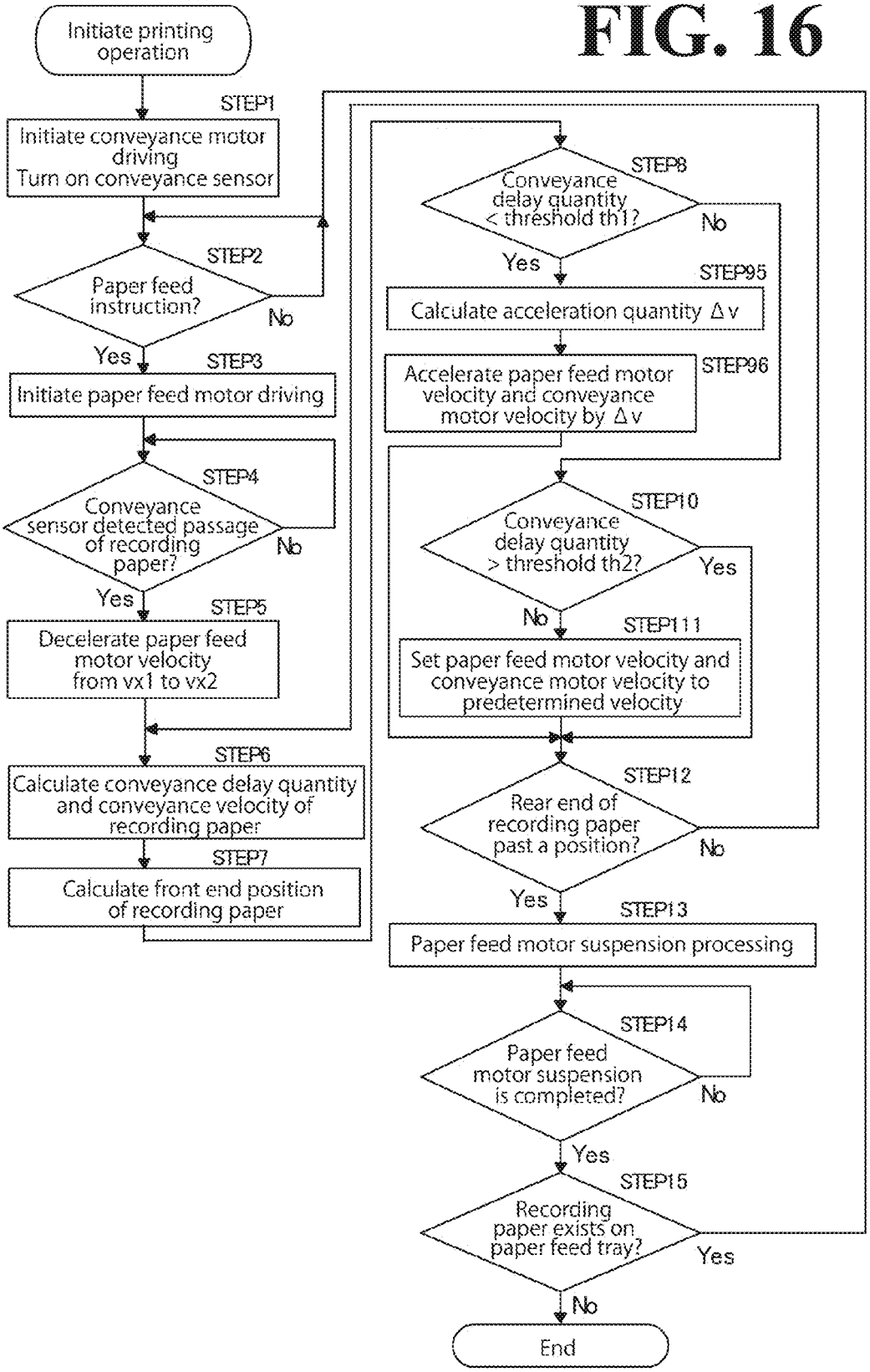
FIG. 16 is a flow chart showing a control operation for a recording paper conveyance performed by the image forming apparatus according to a sixth embodiment.

The sixth embodiment of the present invention will be described below with reference to the drawings. The structure of the image forming apparatus according to the present embodiment is similar to that of the first embodiment. FIG. 16 is a flow chart showing control operations to the conveyance device in the image forming apparatus of the present embodiment. In the flow chart of FIG. 16, units identical to those in the flow chart of FIG. 12 are identified by the same reference numerals, and their respective detailed descriptions are omitted.

A rotation control operation to the pair of paper feed rollers 82 will be described below with reference to the flow chart of FIG. 16. The present embodiment differs from the first embodiment in that the rotational velocity of the pair of conveyance rollers 83 is accelerated on the occasion of a delay in the conveyance velocity of the recording paper P2, and the rotational velocity of the pair of paper feed rollers 82 is accelerated and decelerated so as to follow the pair of conveyance motors 83. That is, when the rotational velocity of the conveyance motor 88 is accelerated by ΔV in order to eliminate the conveyance delay of the recording paper P2, the rotational velocity of the paper feed motor 87 is also accelerated by ΔV. When the conveyance delay of the recording paper P2 is eliminated, the rotational velocities of the paper feed motor 87 and the conveyance motor 88 are respectively decelerated by the amount of acceleration ΔV at the same time.

In the present embodiment, as shown in the flow chart of FIG. 16, when the control unit 10 indicates that the conveyance delay quantity of the recording paper P2 has exceeded the threshold Th1 (Yes in STEP 8), the control unit 10 calculates an amount of acceleration ΔV for eliminating the conveyance delay of the recording paper P2 (STEP 95), and accelerates the rotational velocities of the conveyance motor 88 and the paper feed motor 87 by ΔV (STEP 96). When the control unit 10 indicates that the conveyance delay quantity of the recording paper P2 is already less than the threshold Th2 (Yes in STEP 10), the control unit 10 reduces the rotational velocities of the conveyance motor 88 and the paper feed motor 87 to the rotational velocity before being accelerated (STEP 111).

<Seventh Embodiment>

Figure 17:
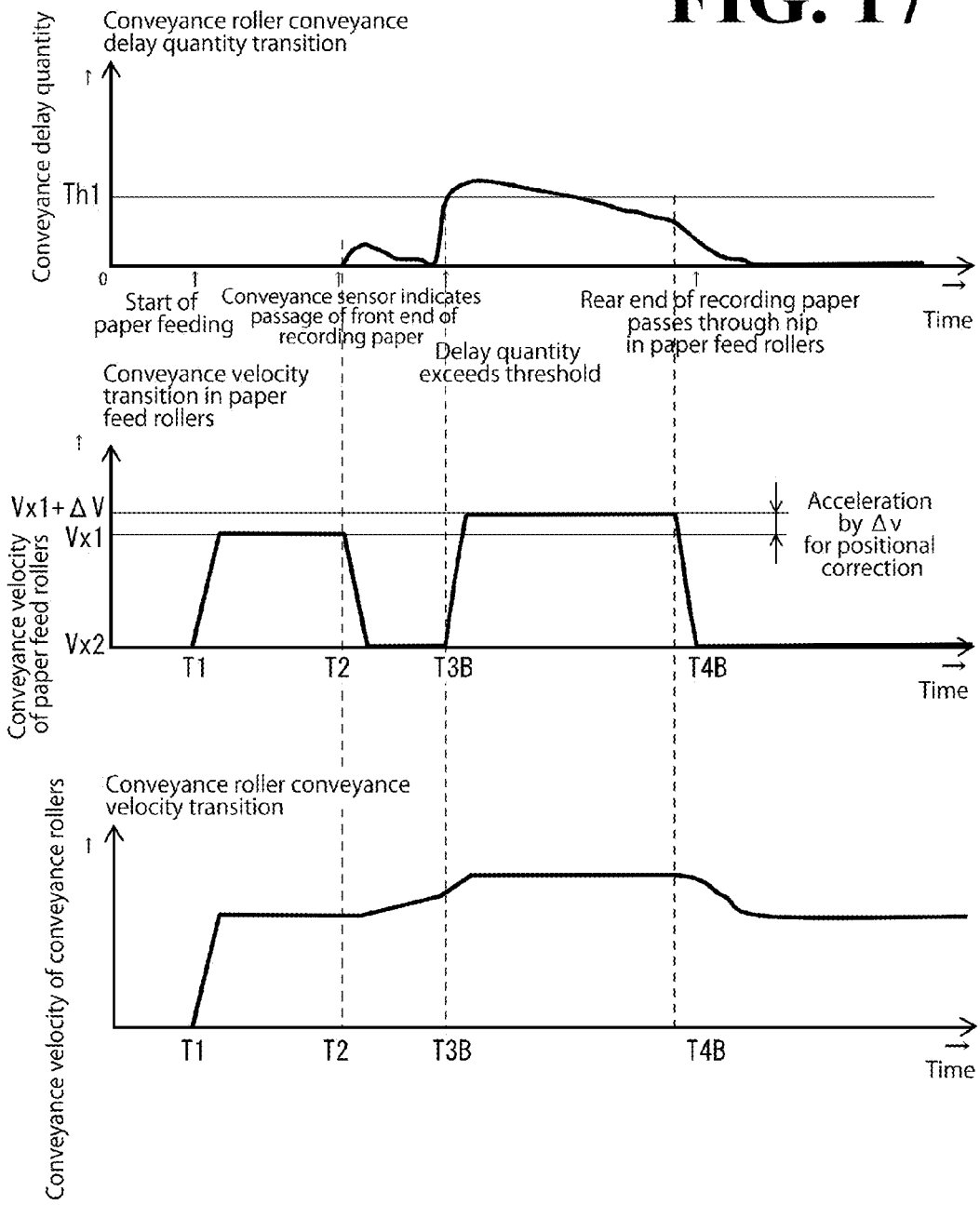
FIG. 17 is a timing chart showing a recording paper conveyance operation performed by the conveyance device in the image forming apparatus according to a seventh embodiment.

The seventh embodiment of the present invention will be described below with reference to the drawings. Similarly to the sixth embodiment, the structure of the image forming apparatus according to the present embodiment is similar to that of the first embodiment. FIG. 17 is a timing chart showing operations of the conveyance device in the image forming apparatus of the present embodiment. In the timing chart of FIG. 17, units identical to those in the timing chart of FIG. 10 are identified by the same reference numerals, and their respective detailed descriptions are omitted.

A rotation control operation to the pair of paper feed rollers 82 will be described below with reference to the timing chart of FIG. 17. The present embodiment differs from the sixth embodiment in that the control unit 10 indicates the conveyance velocity and the conveyance position of the recording paper P2 based on the measurement results obtained with the conveyance sensor 85, and the conveyance control unit 118 controls the rotational velocity of the pair of conveyance rollers 83 all the time so as to ensure that the recording paper P2 is conveyed at a constant velocity. On the occasion of a large conveyance delay quantity of the recording paper P2, the conveyance delay of the recording paper P2 is eliminated by accelerating both of the rotational velocities of the pair of paper feed rollers 82 and the pair of conveyance rollers 83.

Specifically in the present embodiment, as shown in the embodiment of FIG. 17, the control unit 10 calculates the conveyance position and the conveyance velocity of the recording paper P2 so as to obtain velocity information when the paper feeding of the recording paper P2 is initiated at time T1. The control unit 10 then performs a velocity correction arithmetic operation and adjusts the velocity of the conveyance motor 88 by using PI control or PID control so as to ensure that the recording paper P2 is conveyed at a predetermined conveyance velocity. The pair of paper feed rollers 82 rotationally drive at the first rotational velocity Vx1 immediately after the paper feeding at time T1, and is decelerated to the second rotational velocity Vx2 when the conveyance sensor 85 detects the passage of the front end of the recording paper P2 through between the pair of conveyance rollers 83.

Thereafter, when the conveyance delay quantity of the recording paper P2 based on the measurement results obtained with the conveyance sensor 85 exceeds the threshold Th1 at time T3B, the control unit 10 causes the conveyance control unit 118 to accelerate the paper feed motor 87 together with the conveyance motor 88 so as to respectively accelerate the rotational velocities of the pair of paper feed rollers 82 and the pair of conveyance rollers 83 by the amount of acceleration ΔV. Here, the rotational velocity of the pair of conveyance rollers 83 is to be accelerated so that no difference exists between the conveyance position of the recording paper P2 based on the measurement results obtained with the conveyance sensor 85 and an ideal conveyance position. Thus, by conveying the recording paper P2 taking the conveyance position of the recording paper P2 as a control object, variations in the conveyance position of the recording paper P2 due to roller slip and roller diameter error can be suppressed to reduce conveyance intervals of the recording paper P2.

When the rear end of the recording paper P2 passes through the nip region in the pair of paper feed rollers 82 at time T4B, the conveyance control unit 118 causes the paper feed motor 87 to be suspended so as to suspend the rotational drive of the pair of paper feed rollers 82. The conveyance control unit 118 controls the conveyance motor 88 based on the conveyance position and the conveyance velocity of the recording paper P2, thereby allowing the rotational velocity of the pair of conveyance rollers 83 to be set at an optimum value until the rear end of the recording paper P2 passes through the conveyance sensor 85.

Alternatively, the conveyance position of the recording paper P2, which is taken as a control object for controlling the conveyance motor 88, may be calculated at any time assuming that an initial position at which the recording paper P2 is set in the paper feed tray 4 is taken as zero, and a position obtained after being conveyed from there at an ideal velocity is taken as an ideal conveyance position. When the conveyance delay exceeds the threshold Th1, the load exerted on the conveyance motor 88 as the drive source of the pair of conveyance rollers 83 can be reduced by accelerating the paper feed motor 87 even when the rotational velocity of the conveyance motor 88 reaches a maximum. Hence, the conveyance velocity of the recording paper P2 can be accelerated to an ideal value.

Figure 18:
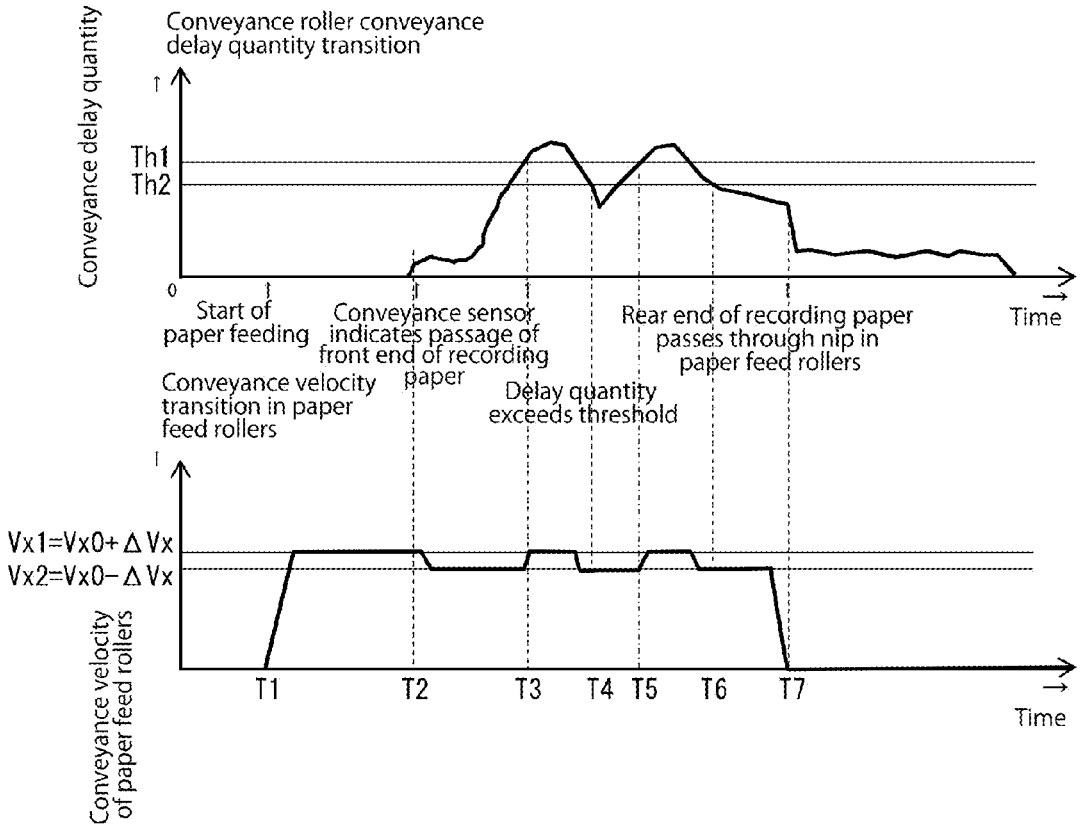
FIG. 18 is a timing chart showing an alternative embodiment of a recording paper conveyance operation performed by the conveyance device in the image forming apparatus according to the embodiment of the present invention.

In each of the foregoing embodiments, when the rotational velocity of the pair of paper feed rollers 82 is changed by the first and second rotational velocities Vx1 and Vx2, the first rotational velocity Vx1 may be set to a rotational velocity (Vx0+ΔVx) that is higher by the amount of ΔVx than the ideal rotational velocity Vx0 of the pair of conveyance rollers 83, and the second rotational velocity Vx2 may be set to a rotational velocity (Vx0−ΔVx) that is lower by the amount of ΔVx than the ideal rotational velocity Vx0, as shown in the embodiment of FIG. 18. Here, the ideal rotational velocity Vx0 is the rotational velocity of the pair of conveyance rollers 83 obtained by including a delay due to a slip provided that the pair of paper feed rollers 82 and the pair of conveyance rollers 83 have the same diameter. On this occasion, a small value of Vx allows the pair of paper feed rollers 82 to reach an accelerated velocity in a short time, thereby improving responsiveness. This ensures a prompt acceleration even on the occasion of a sharp increase in slip.

Figure 19:
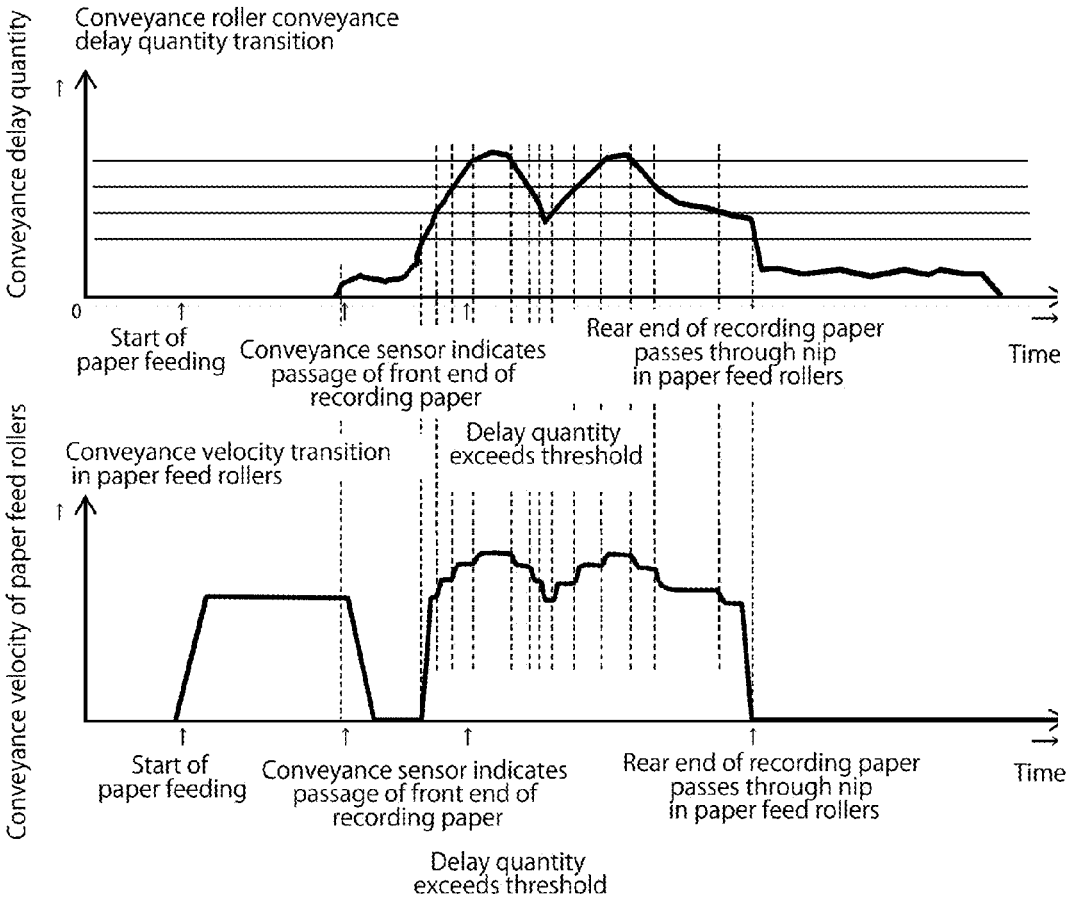
FIG. 19 is a timing chart showing an alternative embodiment of a recording paper conveyance operation performed by the conveyance device in the image forming apparatus according to the embodiment of the present invention.

In each of the foregoing embodiments, the rotational velocity of the pair of paper feed rollers 82 to be accelerated may be changed a plurality of times by having three or more thresholds for controlling the rotational velocity of the pair of paper feed rollers 82 depending on the conveyance delay quantity, as shown in the embodiment of FIG. 19. In the embodiment of FIG. 19, the four thresholds are employed and, after the front end of the recording paper P2 passes through between the pair of conveyance rollers 83, a conveyance delay quantity of the recording paper P2 and these four thresholds are compared, and the rotational velocity of the pair of paper feed rollers 82 can be set at four stages based on the magnitude of the conveyance delay quantity. Thus, by increasing the number of thresholds to be compared with the conveyance delay quantity, the conveyance control to the recording paper 2 can be performed smoothly so as to suppress vibration and noise during the conveyance of the recording paper P2. The delay quantity of the pair of paper feed rollers 82 may be corrected continuously based on the measurement results obtained with the conveyance sensor 85 by using, for example, PI control, with no conveyance delay quantity of the recording paper P2 as a target value.

<Alternative Embodiment 1 for Conveyance Delay Quantity Measurement>

Figure 20:
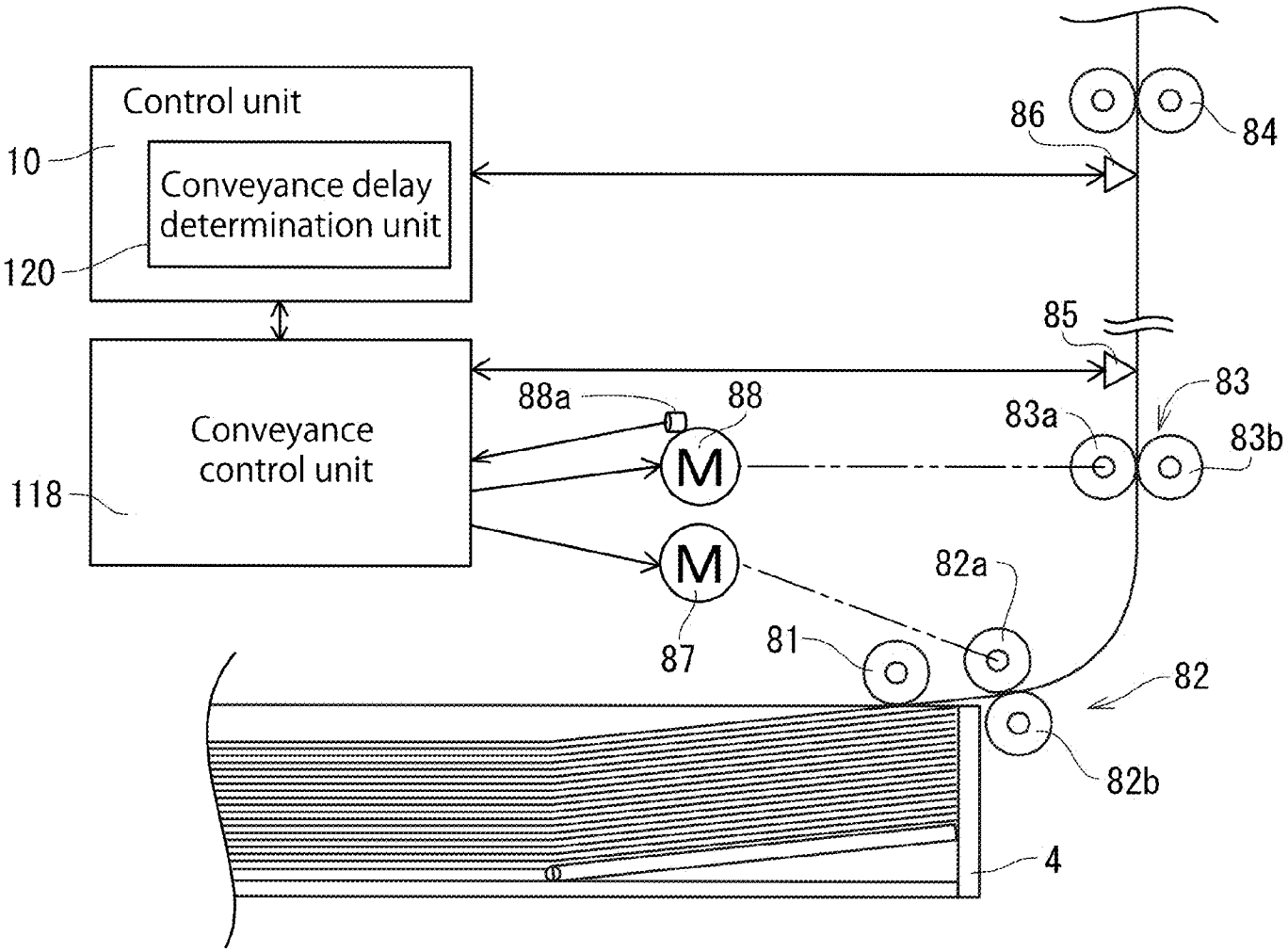
FIG. 20 is a schematic diagram showing an alternative embodiment 1 of a structure for measuring a conveyance delay quantity in the image forming apparatus according to the embodiment of the present invention.

In each of the foregoing embodiments, the conveyance delay quantity is to be calculated based on the conveyance velocity (measured conveyance velocity) of the recording paper P2 obtainable from the measurement signal obtained with the conveyance sensor 85 as in the configuration shown in FIG. 9. It is however possible to make the measurement with a configuration other than the configuration of FIG. 9. In the present embodiment, the conveyance motor 88 is provided with a rotary encoder 88*a* to measure the rotational velocity of the conveyance motor 88 as shown in FIG. 20. The conveyance control unit 118 is to receive an encoder pulse from the rotary encoder 88*a*. By applying an encoder pulse signal received by the conveyance control unit 118 to the control unit 10, the conveyance delay determination unit 120 measures a conveyance delay quantity of the recording paper P2 based on the rotational velocity of the conveyance motor 88.

That is, for example, when the conveyance motor 88 is configured by a direct current motor, a difference between the frequency of the encoder pulse obtained from the rotary encoder 88*a* and an architectonic ideal frequency is to be calculated and used as a conveyance delay frequency of the recording paper P2. When the conveyance motor 88 is configured by a stepping motor, the conveyance delay determination unit 120 is capable of measuring the conveyance delay quantity of the recording paper P2 by a pulse rate of a rectangular wave signal with which the conveyance control unit 118 instructs the rotational velocity of the conveyance motor 88. Therefore, the rotary encoder 88*a* is omittable. Here, a difference between the pulse rate of the rectangular wave signal to be applied to the conveyance motor 88 and the architectonic ideal frequency is calculated and used as a conveyance delay quantity of the recording paper P2. The conveyance delay determination unit 120 in the configuration of the present embodiment is capable of determining the conveyance delay of the recording paper P2 based on a parameter obtainable from the control system of the conveyance sensor 85. Therefore, the processing of information from the conveyance sensor 85 is omittable.

With the configuration of the present embodiment, a conveyance state of the recording paper P2 obtainable from the conveyance sensor 85 is to be monitored and, when an actual conveyance velocity is deviated from an ideal conveyance velocity due to roller diameter variation and paper slip, the conveyance control unit 118 applies feedback control to the conveyance motor 88 so that the rotational velocity of the conveyance motor 88 is corrected into the ideal conveyance velocity. With this configuration, the increase of slip becomes excessive, and the correction to the conveyance velocity of the recording paper P2 by the conveyance motor 88 reaches or approaches a limit (architectonic motor acceleration upper limit). Therefore, it is possible to regard as the occurrence of a conveyance delay when a determination is made that no more correction to the slip of the recording paper P2 is possible. By accelerating the pair of paper feed rollers 82 based on this determination, it is possible to recover from an excessive slip state before exceeding the limit.

A parameter for determining the limit of the conveyance velocity correction is processed in the conveyance control unit 118, and the parameter makes it possible to directly or indirectly determine the correction limit. For example, when the conveyance motor 88 is a stepping motor, the parameter is a pulse rate (frequency of a rectangular wave signal that indicates a rotation speed of the motor). When the conveyance motor 88 is a direct current motor, the parameter will not be limited to motor speed information obtainable from the encoder 88*a* that directly detects the rotation speed of the motor, but it may be a voltage (upper limit voltage) of a signal indicating the rotation speed of the motor, a duty ratio of a PWM signal, or an arithmetic operation value of a rotation speed control arithmetic operation system of the motor.

<Alternative Embodiment 2 for Conveyance Delay Quantity Measurement>

Figure 21:
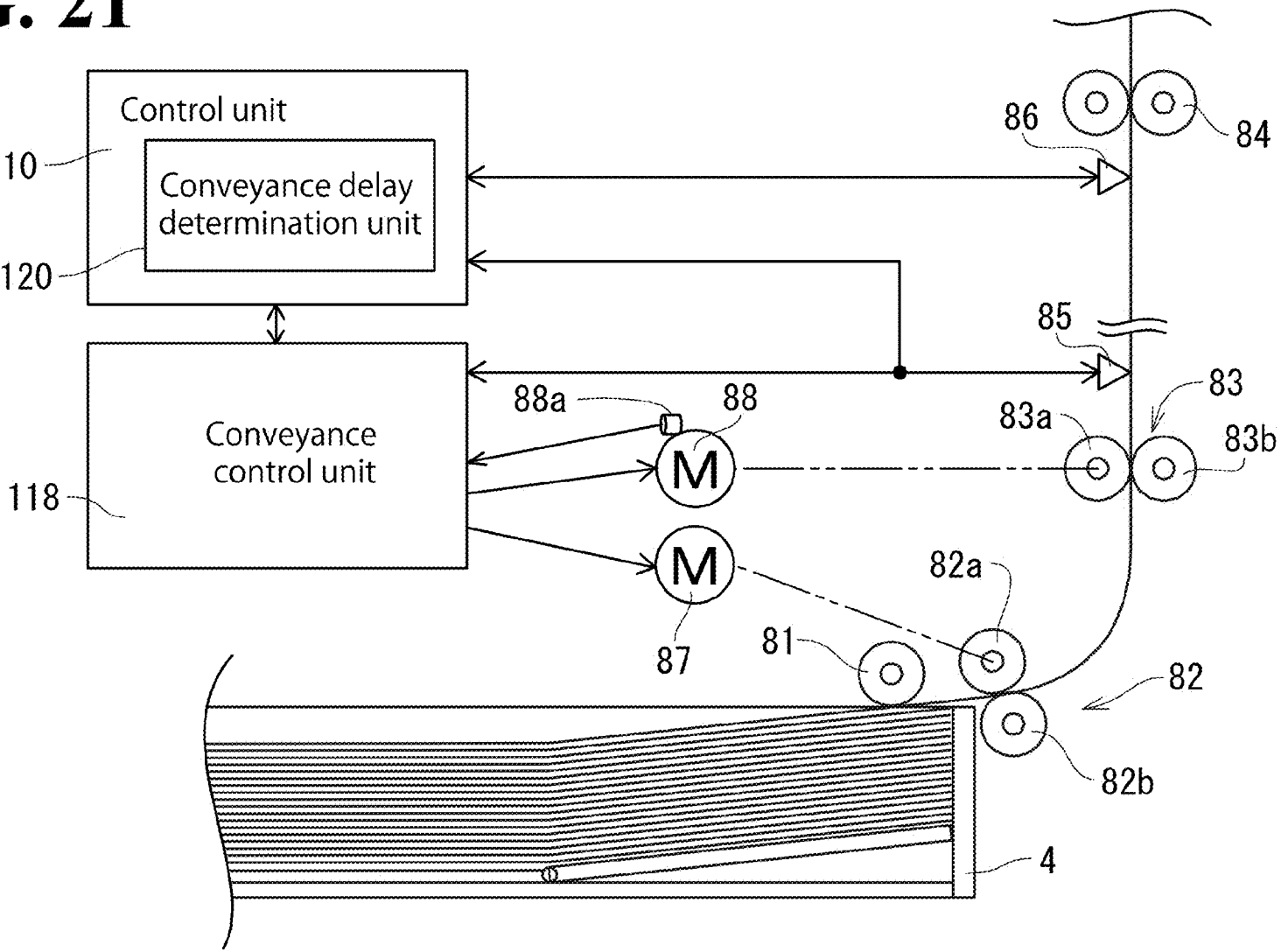
FIG. 21 is a schematic diagram showing an alternative embodiment 2 of the structure for measuring a conveyance delay quantity in the image forming apparatus according to the embodiment of the present invention.

A configurational embodiment of FIG. 21 is shown as a second embodiment of the alternative configuration for calculating a conveyance delay quantity. In the configurational embodiment of FIG. 21, a measurement signal from the conveyance sensor 85 is to be applied to each of the conveyance control unit 118 and the conveyance delay determination unit 120. With this configuration, the conveyance delay determination unit 120 is capable of directly obtaining information from the conveyance sensor 85 and also capable of obtaining control information about the conveyance motor 88 to be performed by the conveyance control unit 120. Therefore, the paper feed motor 87 can be accelerated without waiting for a response of the conveyance control unit 118 even when the slip of the recording paper P2 is sharply increased.

That is, as shown in equation (8), the conveyance delay determination 120 calculates a reference velocity by adding an acceleration/deceleration quantity of the conveyance motor 88 executed by the conveyance control unit 118 to an architectonic conveyance velocity of the recording paper P2, and calculates a conveyance delay quantity by subtracting the conveyance velocity of the recording paper P2 measured by the conveyance sensor 85 from the calculated reference velocity.

Conveyance delay quantity=(Architectonic paper conveyance velocity+Acceleration quantity of conveyance motor)−Velocity detected with paper movement quantity sensor equation (8)

When the slip occurs in a relatively small range, it is possible to perform such control that the conveyance velocity of the recording paper P2 is brought close to an ideal value by accelerating the conveyance motor 88 while referring to information from the conveyance sensor 85. Here, the conveyance delay determination unit 120 can determine whether a non-correctable conveyance delay (slip) actually occurs on the pair of conveyance rollers 83 by, for example, removing the amount of acceleration obtained by slip correction control to the conveyance motor 88 (information obtainable from the drive control unit) from velocity information to be detected by the conveyance sensor 85. Control may be performed to accelerate the paper feed motor 87 only on the occasion of the non-correctable conveyance delay (slip). This ensures cooperation between the slip correction control to the conveyance motor 88 and the acceleration control to the paper feed motor 87 to be performed on the occasion of the slip that cannot be corrected only by the control to the conveyance motor 88.

<Alternative Embodiment 3 for Conveyance Delay Quantity Measurement>

Figure 22:
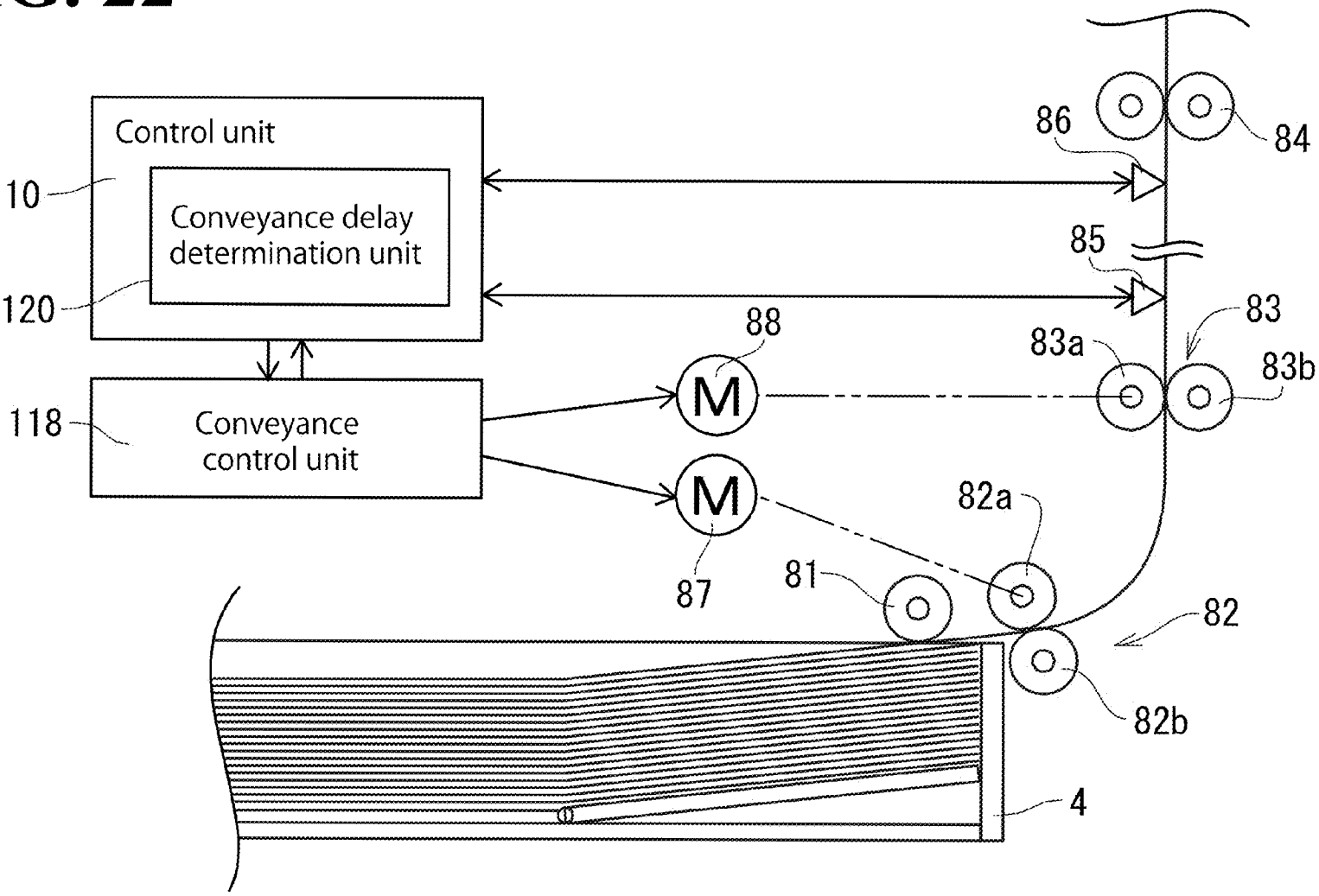
FIG. 22 is a schematic diagram showing an alternative embodiment 1 of the structure for measuring a conveyance delay quantity in the image forming apparatus according to the embodiment of the present invention.

A configurational embodiment of FIG. 22 is shown as a third embodiment of the alternative configuration for calculating a conveyance delay quantity. In the configurational embodiment of FIG. 22, the conveyance delay determination unit 120 is to obtain a conveyance delay quantity of the recording paper P2 based on a conveyance state of the recording paper P2 obtained with the conveyance sensor 85, and a rotational velocity of the conveyance motor 88 to be driven by the conveyance control unit 118. On receipt of a control signal from the conveyance control unit 118, the conveyance delay determination unit 120 calculates a conveyance delay quantity of the recording paper P2 by subtracting a conveyance velocity of the recording paper P2 measured with the conveyance sensor 85, from an architectonic conveyance velocity of the recording paper P2 based on a rotational velocity of the conveyance motor 88 that is being driven. Therefore, the conveyance delay determination unit 120 is capable of calculating the accurate conveyance delay quantity of the recording paper P2 even during a velocity change in the rotational velocity of the conveyance motor 88.

For example, the conveyance motor 88 may be configured by a stepping motor, a plurality of conveyance velocities may be changed, and acceleration and deceleration may be conducted for adjusting the conveyance position. In these embodiments, the measurement information from the conveyance sensor 85 is insufficient for determining a conveyance delay of the recording paper P2. Therefore, upon receipt of a control signal from the conveyance control unit 118, the rotational velocity of the conveyance motor 88 is obtained in real time so as to calculate the conveyance delay quantity based on the present rotational velocity of the conveyance motor 88. That is, with the present embodiment, the conveyance delay of the recording paper P2 is to be determined by comparing the present target feed velocity of the conveyance motor 88 and the information from the conveyance sensor 85. Therefore, even when the conveyance delay of the recording paper P2 is increased during a change in speed of the conveyance motor 88.

<Alternative Configurational Embodiment of Conveyance Device>

Figure 23:
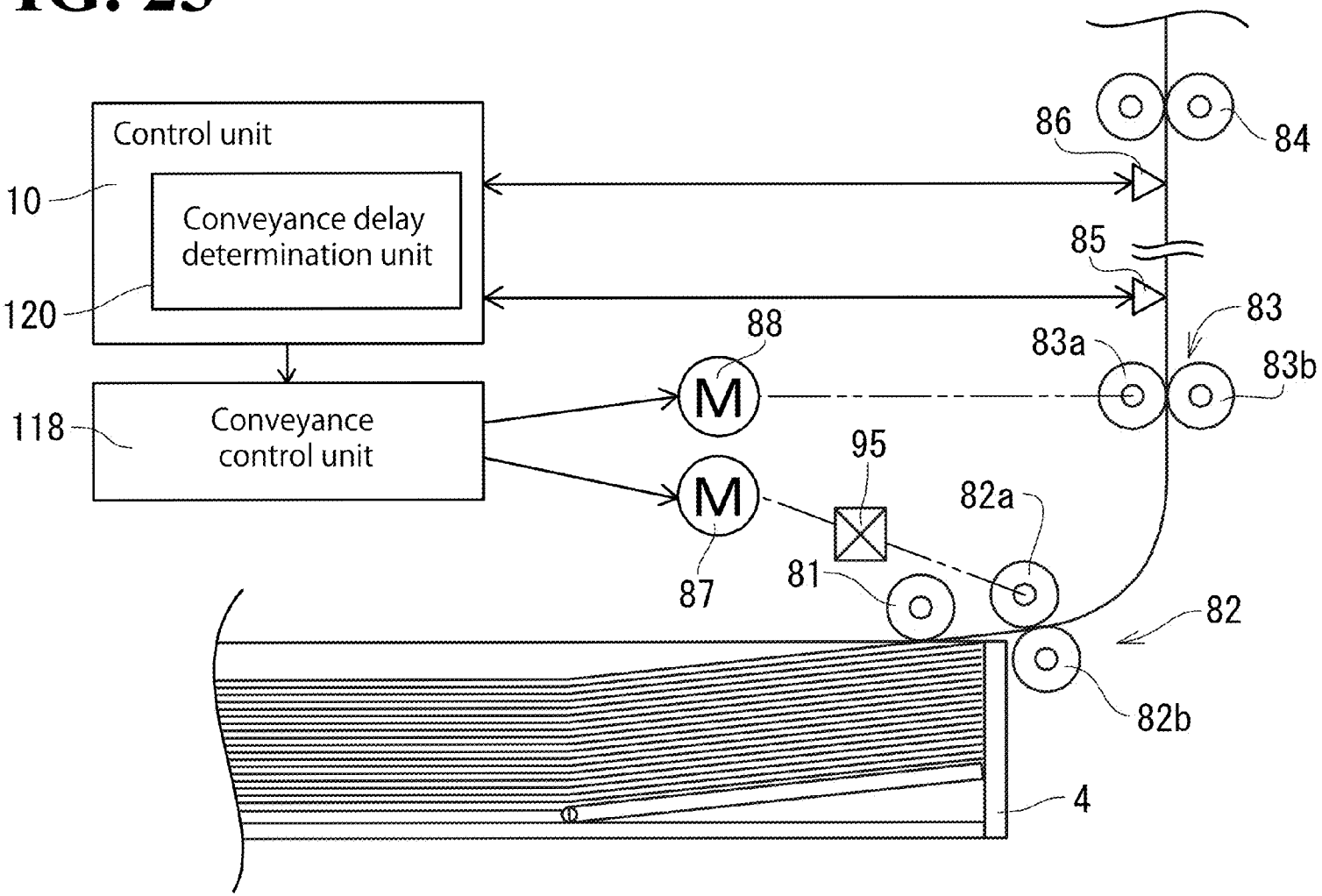
FIG. 23 is a schematic diagram showing an alternative structure of the conveyance device in the image forming apparatus according to the embodiment of the present invention.
Figure 24:
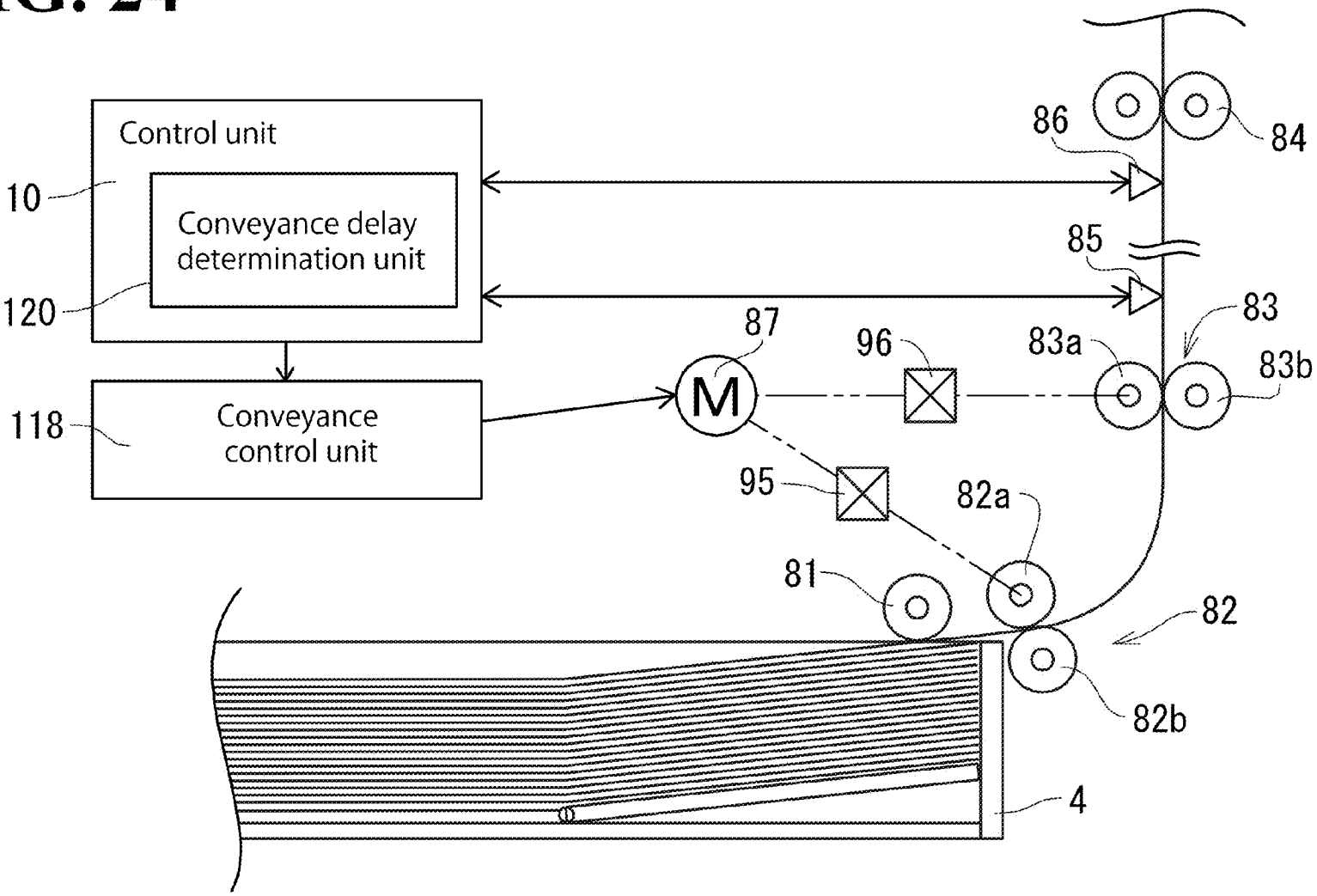
FIG. 24 is a schematic diagram showing an alternative structure of the conveyance device in the image forming apparatus according to the embodiment of the present invention.

In the conveyance device in each of the image forming apparatuses of the foregoing embodiments, as shown in FIG. 9, the paper feed motor 87 and the conveyance motor 88 are respectively directly coupled to the pair of paper feed rollers 82 and the pair of conveyance rollers 83, but the present invention will not be limited thereto. An alternative configurational embodiment of the conveyance device may be, for example, one in which the pair of paper feed rollers 82 are coupled via a clutch 95 as shown in FIG. 23. Another alternative configurational embodiment may be one in which a dynamical system of the single drive motor 87 is drive-branched by a gear and a belt, and the pair of paper feed rollers 82 and the pair of conveyance rollers 83 are respectively coupled to the branched dynamical systems via clutches 95 and 96 as shown in FIG. 24.

In each of these embodiments, when the pair of paper feed rollers 82 are suspended after the recording paper P2 passes through between the pair of conveyance rollers 83 (the second rotational velocity Vx2 is set to zero), the clutch 95 is disengaged to suspend the pair of paper feed rollers 82. When a conveyance delay of the recording paper P2 occurs and the pair of paper feed rollers 82 is rotationally driven at the first rotational velocity Vx1, the clutch 95 is engaged to transmit the rotation obtained from the paper feed motor 87 to the pair of paper feed rollers 82.

The image forming apparatuses according to the embodiments of the present invention may be an MFP (multifunction peripheral) having a coping function, a scanner function, a printer function, and facsimile function, as well as a printer, a coping machine, a facsimile, or the like. The configurations of other units are not limited to the illustrated embodiments, and various changes may be made without departing from the scope of the present invention.

In the image forming apparatus, the conveyance delay determination unit may calculate the conveyance delay quantity from a measurement signal to be issued from the conveyance sensor. The image forming apparatus further includes a conveyance control unit to control the driving source based on input information obtained from the conveyance sensor. The conveyance delay determination unit may calculate the conveyance delay quantity based on a control signal to be issued from the conveyance control unit to the driving source.

The image forming apparatus further includes a conveyance control unit to control the driving source. The conveyance delay determination unit may calculate the conveyance delay quantity based on a measurement signal to be issued from the conveyance sensor and a control signal to be issued from the conveyance control unit to the driving source. Here, the conveyance control unit may control the driving source based on input information obtained from the conveyance sensor.

In any one of the above image forming apparatuses, when after a rotational velocity of the paper feed rollers is accelerated, the conveyance delay determination unit indicates that the conveyance delay quantity is less than the threshold, the rotational velocity of the paper feed rollers may be decelerated to a rotational velocity before being accelerated. Here, the conveyance delay determination unit may apply a threshold for acceleration of a rotational velocity of the paper feed rollers and a threshold for deceleration of a rotational velocity of the paper feed rollers to a rotational velocity before being accelerated, and the threshold for acceleration and the threshold for deceleration may be made different.

In any one of above the image forming apparatuses, when the conveyance delay determination unit indicates that the conveyance delay quantity exceeds the threshold and a rotational velocity of the paper feed rollers is accelerated, after a passage of a predetermined period of time, the rotational velocity of the paper feed rollers may be decelerated to a rotational velocity before being accelerated.

In any one of the image forming apparatuses, when the conveyance delay determination unit indicates that the conveyance delay quantity exceeds the threshold and a rotational velocity of the paper feed rollers is accelerated, the conveyance delay determination unit estimates time required until a rear end of the recording paper passes through a predetermined position and, after a passage of the time thus estimated, the rotational velocity of the paper feed rollers may be decelerated to a rotational velocity before being accelerated.

In any one of the above image forming apparatuses, the threshold to be compared with the conveyance delay quantity is a plurality of values, and an amount of acceleration of a rotational velocity of the paper feed rollers may be changed depending on each of the plurality of thresholds.

In any one of the image forming apparatuses, when the conveyance sensor detects a passage of a front end of the recording paper through between the conveyance rollers, a rotational velocity of the paper feed rollers may be set to a velocity lower than a rotational velocity of the conveyance rollers.

In any one of the image forming apparatuses, when the conveyance delay determination unit determines an occurrence of a conveyance delay of the recording paper by comparing a measurement value indicated by a measurement signal to be issued from the conveyance sensor and a target value, a rotational velocity of the conveyance rollers may be accelerated based on a relationship between the measurement value and the target value.

When accelerating the paper feed rollers, a rotational velocity of the paper feed rollers may be accelerated in conjunction with a rotational velocity of the conveyance rollers. The measurement value indicated by the measurement signal to be issued from the conveyance sensor is any one of a conveyance velocity of a recording paper, a conveyance position of the recording paper, and an amount of movement of the recording paper.

According to the embodiments according to the embodiment of the present invention, when the fed recording paper slips by the conveyance rollers, the conveyance sensor is capable of directly detecting a conveyance velocity of the recording paper, thus ensuring accurate detection of the amount of the slip of the recording paper. Additionally, the paper feed rollers disposed on the upstream side of the conveyance rollers is accelerated to assist the conveyance rollers, thus contributing to reducing the load on the conveyance rollers. This suppresses the slip on the conveyance rollers so as to prevent the occurrence of timer jam due to non-arrival of timing rollers. On the occurrence of a large amount of slip with respect to the recording paper, the conveyance rollers are also accelerated together with the paper feed rollers so as to recover the conveyance delay of the recording paper, thereby preventing the deterioration of productivity of the recording paper conveyance.

Obviously, numerous modifications and variations according to the embodiment of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus comprising:

paper feed rollers and conveyance rollers disposed sequentially from an upstream side along a conveyance path for a recording paper;

a driving source configured to transmit a rotational power to the paper feed rollers and the conveyance rollers;

a conveyance sensor disposed downstream of the conveyance rollers so as to measure a position and a conveyance velocity of the recording paper to be conveyed along the conveyance path;

a control unit configured to detect that the recording paper has reached the conveyance sensor and configured to reduce a rotational velocity of the paper feed rollers; and a conveyance delay determination unit configured to calculate a conveyance delay quantity of the recording paper on the conveyance path and compare the conveyance delay quantity and a predetermined threshold when a conveyance delay of the recording paper is caused to occur after the control unit reduces the rotational velocity of the paper feed rollers based on the position and the conveyance velocity of the recording paper measured by the conveyance sensor, wherein when the conveyance delay determination unit indicates that the conveyance delay quantity exceeds the threshold, the driving source is configured to accelerate a rotational velocity of the paper feed rollers.

2. The image forming apparatus according to claim 1, wherein the conveyance delay determination unit is configured to calculate the conveyance delay quantity from a measurement signal to be issued from the conveyance sensor.

3. The image forming apparatus according to claim 2, wherein when after a rotational velocity of the paper feed rollers is accelerated, the conveyance delay determination unit indicates that the conveyance delay quantity is less than the threshold, the rotational velocity of the paper feed rollers is decelerated to a rotational velocity before being accelerated.

4. The image forming apparatus according to claim 3, wherein the conveyance delay determination unit applies a threshold for acceleration of a rotational velocity of the paper feed rollers and a threshold for deceleration of a rotational velocity of the paper feed rollers to a rotational velocity before being accelerated, and the threshold for acceleration and the threshold for deceleration are made different.

5. The image forming apparatus according to claim 1, further comprising:

a conveyance control unit configured to control the driving source based on input information from the conveyance sensor, wherein the conveyance delay determination unit is configured to calculate the conveyance delay quantity based on a control signal to be issued from the conveyance control unit to the driving source.

6. The image forming apparatus according to claim 5, wherein when after a rotational velocity of the paper feed rollers is accelerated, the conveyance delay determination unit indicates that the conveyance delay quantity is less than the threshold, the rotational velocity of the paper feed rollers is decelerated to a rotational velocity before being accelerated.

7. The image forming apparatus according to claim 6, wherein the conveyance delay determination unit applies a threshold for acceleration of a rotational velocity of the paper feed rollers and a threshold for deceleration of a rotational velocity of the paper feed rollers to a rotational velocity before being accelerated, and the threshold for acceleration and the threshold for deceleration are made different.

8. The image forming apparatus according to claim 1, further comprising:

a conveyance control unit configured to control the driving source, wherein the conveyance delay determination unit is configured to calculate the conveyance delay quantity based on a measurement signal to be issued from the conveyance sensor and a control signal to be issued from the conveyance control unit to the driving source.

9. The image forming apparatus according to claim 8, wherein the conveyance control unit is configured to control the driving source based on input information obtained from the conveyance sensor.

10. The image forming apparatus according to claim 9, wherein when after a rotational velocity of the paper feed rollers is accelerated, the conveyance delay determination unit indicates that the conveyance delay quantity is less than the threshold, the rotational velocity of the paper feed rollers is decelerated to a rotational velocity before being accelerated.

11. The image forming apparatus according to claim 8, wherein when after a rotational velocity of the paper feed rollers is accelerated, the conveyance delay determination unit indicates that the conveyance delay quantity is less than the threshold, the rotational velocity of the paper feed rollers is decelerated to a rotational velocity before being accelerated.

12. The image forming apparatus according to claim 1, wherein when after a rotational velocity of the paper feed rollers is accelerated, the conveyance delay determination unit indicates that the conveyance delay quantity is less than the threshold, the rotational velocity of the paper feed rollers is decelerated to a rotational velocity before being accelerated.

13. The image forming apparatus according to claim 12, wherein the conveyance delay determination unit applies a threshold for acceleration of a rotational velocity of the paper feed rollers and a threshold for deceleration of a rotational velocity of the paper feed rollers to a rotational velocity before being accelerated, and the threshold for acceleration and the threshold for deceleration are made different.

14. The image forming apparatus according to claim 1, wherein when the conveyance delay determination unit indicates that the conveyance delay quantity exceeds the threshold and a rotational velocity of the paper feed rollers is accelerated, after a passage of a predetermined period of time, the rotational velocity of the paper feed rollers is decelerated to a rotational velocity before being accelerated.

15. The image forming apparatus according to claim 1, wherein when the conveyance delay determination unit indicates that the conveyance delay quantity exceeds the threshold and a rotational velocity of the paper feed rollers is accelerated, the conveyance delay determination unit estimates time required until a rear end of the recording paper passes through a predetermined position and, after a passage of the time thus estimated, the rotational velocity of the paper feed rollers is decelerated to a rotational velocity before being accelerated.

16. The image forming apparatus according to claim 1, wherein the threshold to be compared with the conveyance delay quantity is a plurality of values, and an amount of acceleration of a rotational velocity of the paper feed rollers is changed depending on each of the plurality of thresholds.

17. The image forming apparatus according to claim 1, wherein when the conveyance sensor detects a passage of a front end of the recording paper through between the conveyance rollers, a rotational velocity of the paper feed rollers is set to a velocity lower than a rotational velocity of the conveyance rollers.

18. The image forming apparatus according to claim 1, wherein when the conveyance delay determination unit determines an occurrence of a conveyance delay of the recording paper by comparing a measurement value indicated by a measurement signal to be issued from the conveyance sensor and a target value, a rotational velocity of the conveyance rollers is accelerated based on a relationship between the measurement value and the target value.

19. The image forming apparatus according to claim 18, wherein when accelerating the paper feed rollers, a rotational velocity of the paper feed rollers is accelerated in conjunction with a rotational velocity of the conveyance rollers.

20. The image forming apparatus according to claim 18, wherein the measurement value indicated by the measurement signal to be issued from the conveyance sensor is any one of a conveyance velocity of a recording paper, a conveyance position of the recording paper, and an amount of movement of the recording paper.

21. The image forming apparatus according to claim 1, further comprising timing rollers disposed on a downstream side of the conveyance rollers in a conveyance direction of the recording paper, wherein the recording paper conveyed by the conveyance rollers comes into contact with a nip defined between the timing rollers in a stationary state so as to form a loop to correct a skew of the recording paper.

* * * * *